United States Patent [19]

Latty et al.

[11] Patent Number: 4,930,454

[45] Date of Patent: Jun. 5, 1990

[54] STEAM GENERATING SYSTEM

[75] Inventors: James A. Latty, San Juan Capistrano; Spencer Eisenbarth, Costa Mesa, both of Calif.

[73] Assignee: Dresser Industries, Inc., Dallas, Tex.

[21] Appl. No.: 292,761

[22] Filed: Aug. 14, 1981

[51] Int. Cl.[5] ..... F22B 1/00

[52] U.S. Cl. ..... 122/4 D; 122/28; 166/59; 166/252; 166/303; 431/7

[58] Field of Search ..... 431/7, 9, 76, 115, 116, 431/158, 170; 166/53, 59, 250, 251, 252, 303, 260, 262; 60/39.59, 723; 175/12, 14; 122/4 D, 28

[56] References Cited

U.S. PATENT DOCUMENTS

| | | | |
|---|---|---|---|
| 2,259,010 | 10/1941 | Taylor | 60/45 |
| 2,624,172 | 1/1953 | Houdry | 60/39.04 |
| 3,199,505 | 8/1965 | Lloyd | 126/95 |
| 3,216,498 | 11/1965 | Palm | 166/38 |
| 3,223,166 | 12/1965 | Hunt et al. | 166/38 |
| 3,244,231 | 4/1966 | Grekel et al. | 166/38 |
| 3,322,195 | 5/1967 | Brown et al. | 166/38 |
| 3,353,360 | 11/1967 | Gorzegro | 60/39.59 |
| 3,369,361 | 2/1968 | Craig | 60/39.59 |
| 3,420,300 | 1/1969 | Todd | 166/38 |
| 3,456,721 | 7/1969 | Smith | 166/59 |
| 3,804,163 | 4/1974 | Bradley et al. | 166/59 |
| 3,817,332 | 6/1974 | Berry et al. | 166/302 |
| 3,892,270 | 7/1975 | Lindquist | 166/252 |
| 3,914,090 | 11/1975 | Pfefferle | 431/9 |
| 3,921,389 | 11/1975 | Kawaguchi | 60/39.59 |
| 3,928,961 | 12/1975 | Pfefferle | 431/7 |
| 3,934,969 | 1/1976 | Noda et al. | 431/115 |
| 3,958,915 | 5/1976 | Noda et al. | 431/9 |
| 3,982,591 | 9/1976 | Hamrick et al. | 166/302 |
| 3,982,878 | 9/1976 | Yamane et al. | 431/115 |
| 4,038,032 | 7/1977 | Brewer et al. | 23/230 A |
| 4,053,015 | 10/1977 | Hamrick et al. | 166/302 |
| 4,065,917 | 1/1978 | Pfefferle | 60/723 |

(List continued on next page.)

FOREIGN PATENT DOCUMENTS

| | | |
|---|---|---|
| 1532793 | 11/1970 | United Kingdom . |
| 1535330 | 12/1978 | United Kingdom . |
| 1575427 | 9/1980 | United Kingdom . |
| 2047267 | 11/1980 | United Kingdom . |
| 1601687 | 11/1981 | United Kingdom . |
| 2077135 | 3/1984 | United Kingdom . |

OTHER PUBLICATIONS

European patent application 0062149A-1.

IEEE Transactions on Industry Applns.-vol. IA-17, #2, "Controlling Excess Oxygen in Glass Furnaces for Energy Conservation",-pp. 230-235.

The WAO Boiler for Enhanced Oil Recovery, S. E. Balog, Manager Reservoir Engineering, R. K. Kerr, Supervisor, Research & Development, Alberta Energy Company Ltd.

Western States Section "The Combustion Institute", 1980 Spring Meeting-Apr. 21-22, 1980.

*Primary Examiner*—Edward G. Favors

[57] ABSTRACT

Disclosed is a catalytic combustor and systems for the boilerless stoichiometric production of a working fluid such as steam from a fuel-mixture comprised of a carbonaceous fuel and a diluent such as water mixed in a thermally self-extinguishing mass ratio. Production of the steam is by a controlled substantially stoichiometric process utilizing a combustor to provide steam over a wide range of heat release rates, temperatures and pressures for steam flooding an oil bearing formation. Even though formation characteristics change during a steam flooding operation, output steam of the combustor may be kept at a constant heat release rate by dividing the total amount of water passing through combustor between a first portion which is included in the fuel-mixture and a second portion which is injected into the heated products of combustion. In this way, the space velocity of the fluid stream passing through the combustor catalyst may be kept within operational limits of the catalyst while maintaining stoichiometric combustion. When necessary, preheating of at least one of the components of the mixture burned in the catalyst is provided by a portion of the heat of combustion.

80 Claims, 11 Drawing Sheets

U.S. PATENT DOCUMENTS

| | | | |
|---|---|---|---|
| 4,077,469 | 3/1978 | Hamrick et al. | 166/59 |
| 4,102,125 | 7/1978 | Schelp | 60/39.59 |
| 4,130,388 | 12/1978 | Flanagan | 431/116 |
| 4,151,259 | 4/1979 | Hollingsworth | 423/167 |
| 4,154,568 | 5/1979 | Kendall et al. | 431/7 |
| 4,173,455 | 11/1979 | Fodor et al. | 44/51 |
| 4,189,294 | 2/1980 | Rice et al. | 431/7 |
| 4,204,829 | 5/1980 | Kendall | 431/7 |
| 4,237,973 | 12/1980 | Todd | 166/59 |
| 4,241,722 | 12/1980 | Dickinson | 126/263 |
| 4,250,962 | 2/1981 | Madgaukar et al. | 60/723 |
| 4,288,978 | 9/1981 | Wyatt | 60/39.05 |
| 4,342,551 | 8/1982 | Browning | 431/158 |
| 4,354,821 | 10/1982 | Kesselring et al. | 431/7 |
| 4,362,499 | 12/1982 | Nethery | 431/76 |

FIG. 12
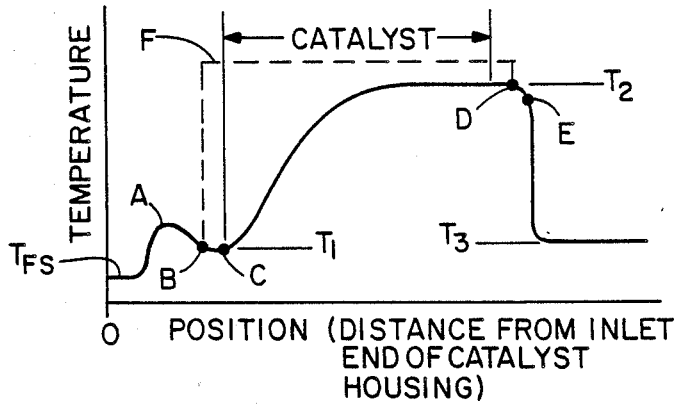
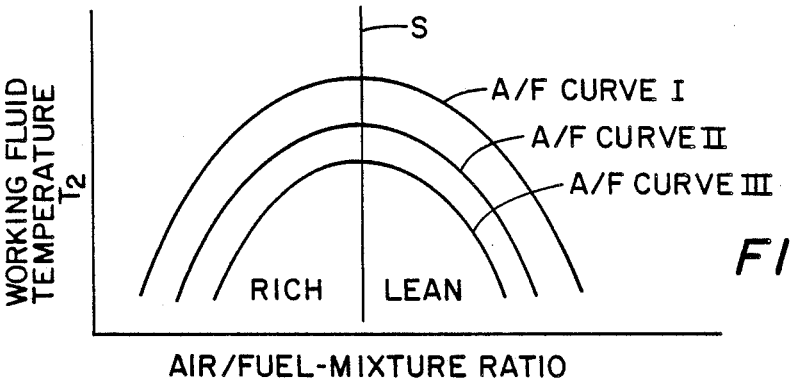
FIG. 13
FIG. 14
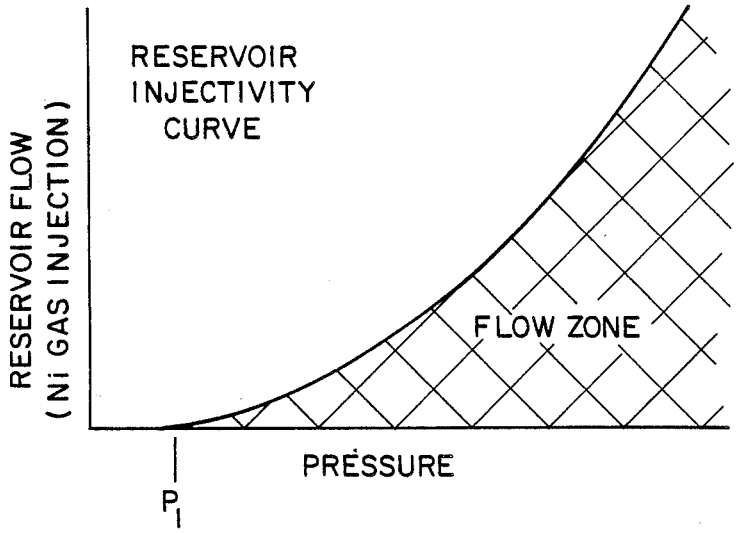

STEAM GENERATING SYSTEM

TECHNICAL FIELD

The present invention relates to a system, apparatus, fuel and method utilized in producing a heated working fluid such as steam.

BACKGROUND ART

One prior art patent disclosing a catalytic combustor such as may be used in the production of steam for enhanced oil recovery is U.S. Pat. No. 4,237,973. Another combustor which may be used to produce steam downhole includes U.S. Pat. No. 3,456,721. One method of start-up for a downhole combustor is disclosed in U.S. Pat. No. 4,053,015 relating to the use of a start fuel plug. Some characteristics of fuels used in combustors are mentioned in U.S. Pat. No. 3,420,300 and the injection of water to cool products of combustion are disclosed in U.S. Pat. No. 3,980,137. Another United States patent which may be of interest is 3,223,166.

Definitions

Unless indicated otherwise, the following definitions apply to their respective terms wherever used herein:

adiabatiq flame temperature: the highest possible combustion temperature obtained under the conditions that the burning occurs in an adiabatic vessel, that it is complete, and that dissociation does not occur.

admixture: the formulated product of mixing two or more discrete substances.

air: any gas mixture which includes oxygen.

combustion: the burning of gas, liquid, or solid in which the fuel is oxidizing, evolving heat and often light.

combustion temperature: the temperature at which burning occurs under a given set of conditions, and which may not be necessarily stoichiometric or adiabatic.

instantaneous ignition temperature: that temperature at which, under standard pressure and with stoichiometric quantities of air, combustion of a fuel will occur substantially instantaneously.

spontaneous ignition temperature: the lowest possible temperature at which combustion of a fuel will occur given sufficient time in an adiabatic vessel at standard pressure and with oxygen present.

theoretical adiabatic flame temperature: the adiabatic flame temperature of a mixture containing fuel when combusted with a stoichiometric quantity of oxygen atmospheric air when the mixture and atmospheric air are supplied at standard temperature and pressure.

DISCLOSURE OF INVENTION

The present invention contemplates a new and improved boilerless steam generating process and a system including a combustor for carrying out the process whereby carbonaceous fuel, water and substantially stoichiometric quantities of air form a burn-mixture which may be combusted catalytically to produce steam by utilizing the heat of combustion to heat the water directly. Generally, invention herein lies not only in the aforementioned process and system but also in the proportional combination of water and carbonaceous fuel together to form a fuel mixture which is fed into the combustor for combustion. Specifically, herein, the fuel mixture is mixed in a thermally self-extinguishing mass ratio, in that, the ratio of water to fuel is such that the theoretical adiabatic flame temperature for the mixture is below that temperature necessary to support a stable flame in a conventional thermal combustor.

Water is of course well known as a useful working fluid due at least in part to its high heat capacity and the fact that it passes through a phase change from a liquid to a gas at relatively normal temperatures. The present invention in its broadest sense, however, should not be considered as being limited to the production of steam as a working fluid. Virtually any non-combustable diluent having a high heat capacity may be mixed with the fuel to produce a suitable working fluid. For example, carbon dioxide may be used as a diluent under some circumstances instead of water while still practicing the present invention.

More particularly, the present invention resides in the use of a catalyst as the primary combustion means in a combustor for low temperature, stoichiometric combustion of a carbonaceous fuel to directly heat a quantity of water proportionally divided in first and second amounts which are added selectively (1) to the fuel prior to catalytic combustion to form a controlled fuel-mixture to control combustion temperature in the catalyst and the space velocity of the fluids passing over the catalyst for combustion purposes, and (2) to the highly heated fluid exiting the catalyst to cool such fluid prior to exiting the combustor and thereby control the temperature of the heated working fluid produced by the combustor.

In addition to the foregoing, invention also resides in the novel manner of controlling the combustor for the burn-mixture to combust stably at temperatures considerably below the normal combustion temperature for the fuel even though the burn-mixture includes substantially stoichiometric quantities of carbonaceous fuel and air. Several advantages result from such low temperature, stoichiometric combustion particularly in that, the products of combustion are not highly chemically active, the formation of oxides of nitrogen is avoided, virtually all the oxygen in the air is used and soot formation is kept remarkably low.

Still further invention resides in the novel manner in which the combustor is started and shut down, particularly during start-up, in the control and mixing of fuel to assure that a light-off temperature is attained for the catalyst in the combustor before introducing the steam-generating burn-mixture, and during shut down to keep the catalyst from becoming wetted.

Another novel aspect of the present invention lies in the construction of the combustor so as to catalytically combust the thermally self-extinguishing fuel-mixture and, perhaps more generally, in the discovery that a fuel-mixture comprising diluent to fuel mass ratios generally in the range of 1.6:1 to 11:1 may be combusted with substantially stoichiometric quantities of oxidant to produce a useful working fluid. Advantageously, the exemplary combustor provides for simple, efficient clean combustion of heavy hydrocarbon fuels.

Another important aim of the present invention is to provide a combustor and operating system therefore and a method of operating the same to enable the production of steam at different pressures, temperatures and rates of flow, which are somewhat independent of each other within limits, so that a single combustor can be used for example in enhanced oil recovery to treat oil bearing formations having widely different flow characteristics, the combustor being usable on each such formation to maximize the production of oil from the formation while minimizing the consumption of energy during such production.

The present invention also contemplates a unique system for preheating either the air or the fuel-mixture prior to entry into the combustor with heat generated by the combustion of fuel-mixture in the combustor.

Novel controls also are provided for regulating the temperature of the steam produced by the combustor to be within a specified low range of temperatures within which the catalyst is capable of functioning to produce steam, that is, for example between the light-off temperature of the catalyst and the temperature for its upper limit of stability. Additionally, controls and means are provided for injecting water into the steam produced by combustion over the catalyst to cool the steam and convert further amounts of water into steam.

More particularly, the present invention contemplates a novel manner of controlling the catalytic combustor to produce steam over a wide range of different temperatures, pressures and heat release rates such as may be desired to match the combustor output to the end use contemplated. Thus, for example, a desired change in the heat release rate of the combustor may be achieved by changing the rate of flow of carbonaceous fuel through the combustor and making corresponding proportional changes in, the flow rate of the oxidant or air necessary for substantially stoichiometric combustion, and the total quantity of water passing through the combustor to produce the steam. Advantageously, extension of the operating range of the combustor may be achieved by making use of the range of operating temperatures of the catalyst and space velocities at which the burn-mixture may be passed through the catalyst while still maintaining substantially complete combustion of the burn-mixture. This may be accomplished by adjusting the proportion of the water in the fuel-mixture (the combustion water) and making a complimentary change in the proportion of injection water so as to operate the catalyst within an acceptable range of space velocities with the discharge temperature of the steam exiting the combustor being kept at substantially the same level as before the adjustment. In this way, the heat release rate may be changed without a corresponding change in the discharge temperature all the while keeping the space velocity of the burn-mixture through the catalyst within an acceptable range for stable operation of the combustor.

These and other features and advantages of the present invention will become more apparent from the following description of the best modes of carrying out the invention when considered in conjunction with the accompanying drawings.

BRIEF DESCRIPTION OF DRAWINGS

FIGS. 12 and 13 are graphs useful in understanding the operation and control of the exemplary systems.

FIG. 14 is a representative injectivity curve for pressurized injection of nitrogen gas into a formation bearing heavy oil.

BEST MODES OF CARRYING OUT THE INVENTION

Figure 1:
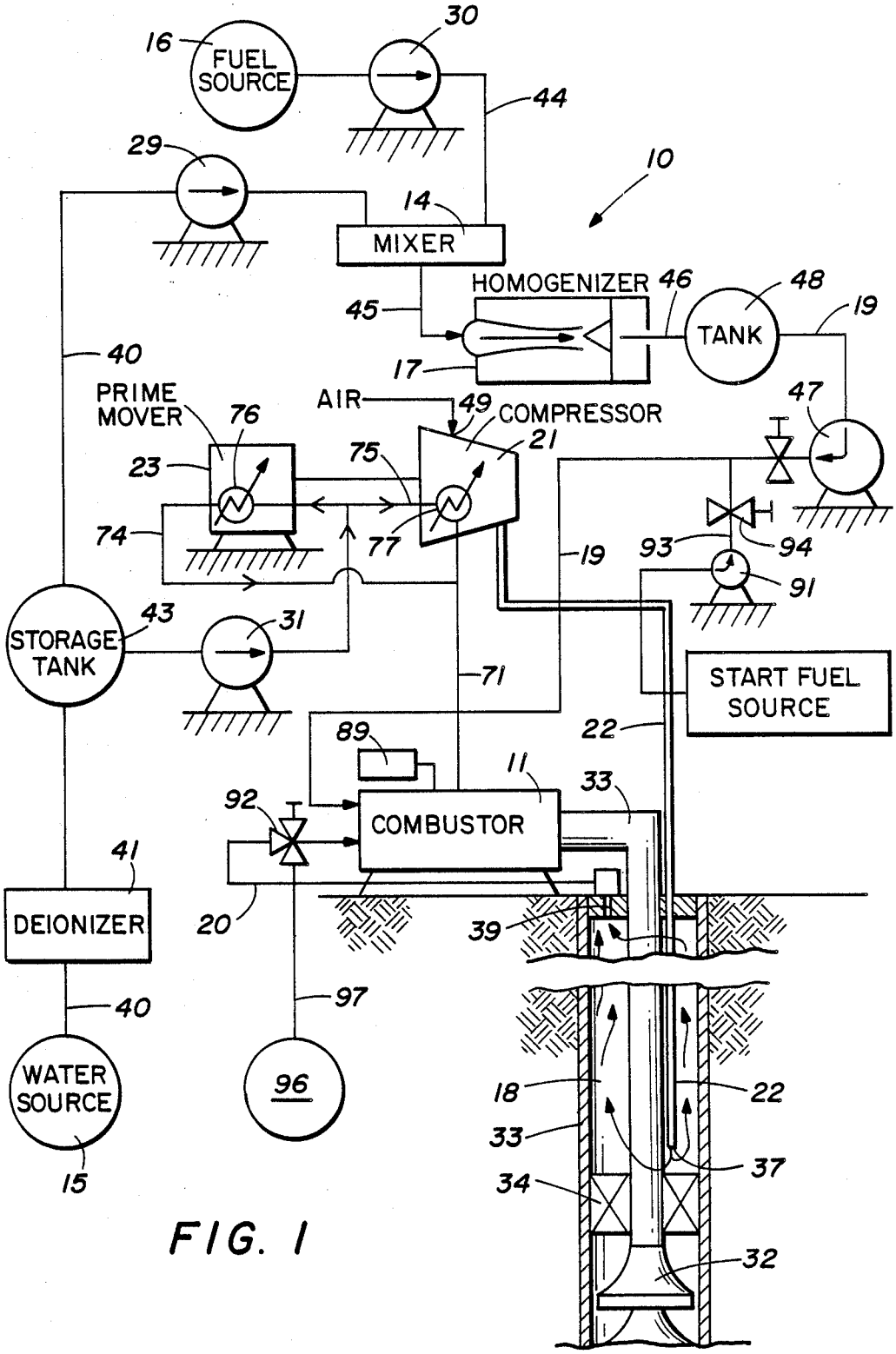
FIG. 1 is a schematic diagram of one embodiment of a steam generating system embodying the novel features of the present invention.

As shown in the drawings for purposes of illustration, the present invention is embodied in a boilerless steam generator such as may be used in the petroleum industry for enhanced oil recovery. It will be appreciated, however, the present invention is not limited to use in the production of steam for enhanced oil recovery, but may be utilized in virtually any set of circumstances wherein when it may be desirable to heat a fluid by combustion of a fuel such as in making a heated working fluid or in the processing of a fluid for other purposes. In the production of steam or any other heated working fluid, it is desirable to be both mechanically and thermally efficient to enable the greatest amount of work to be recovered at the least cost. It also is desirable that in the process of producing the working fluid damage to the environment be avoided.

The present invention contemplates a unique fuel-mixture and a novel combustion system 10 including a new combustor 11, all providing for more efficient pollution-free production of a heated working fluid at relatively low combustion temperatures. For these purposes, the fuel-mixture is catalytically combusted in a novelly controlled manner in the combustor to produce the working fluid. Specifically, the fuel-mixture contemplated herein is an admixture comprised of a diluent, such as water, and a carbonaceous fuel mixed in a thermally self-extinguishing mass ratio. The amount of water in this mixture is dependent, at least in part, upon the heat content of the fuel portion of the fuel-mixture to regulate the temperature of combustion of the fuel-mixture when burnt in a catalytic combustion zone 13 (see FIG. 2) in the combustor 11. Specifically, the combustion temperature is kept within a predesignated low temperature range. Control also is provided to assure the delivery of substantially stoichiometric quantities of oxidant to the catalyst for mixing with the fuel-mixture to form a burn-mixture which passes over a catalyst 12 in the combustion zone 13. Advantageously, the high ratio of diluent to fuel in the fuel-mixture keeps the theoretical adiabatic flame temperature of the mixture low so that the combustion temperature also is low thereby avoiding the formation of thermal nitrous oxides and catalyst stability problems otherwise associated with high temperature combustion. Additionally, catalytic combustion of the fuel-mixture avoids soot and carbon monoxide problems normally associated with thermal combustion and, by combusting substantially stoichiometrically, lower power is required to deliver oxidant to the combustor. Moreover the working fluid produced in this manner is virtually oxygen free and thus is less corrosive than thermal combustion products.

Figure 3:
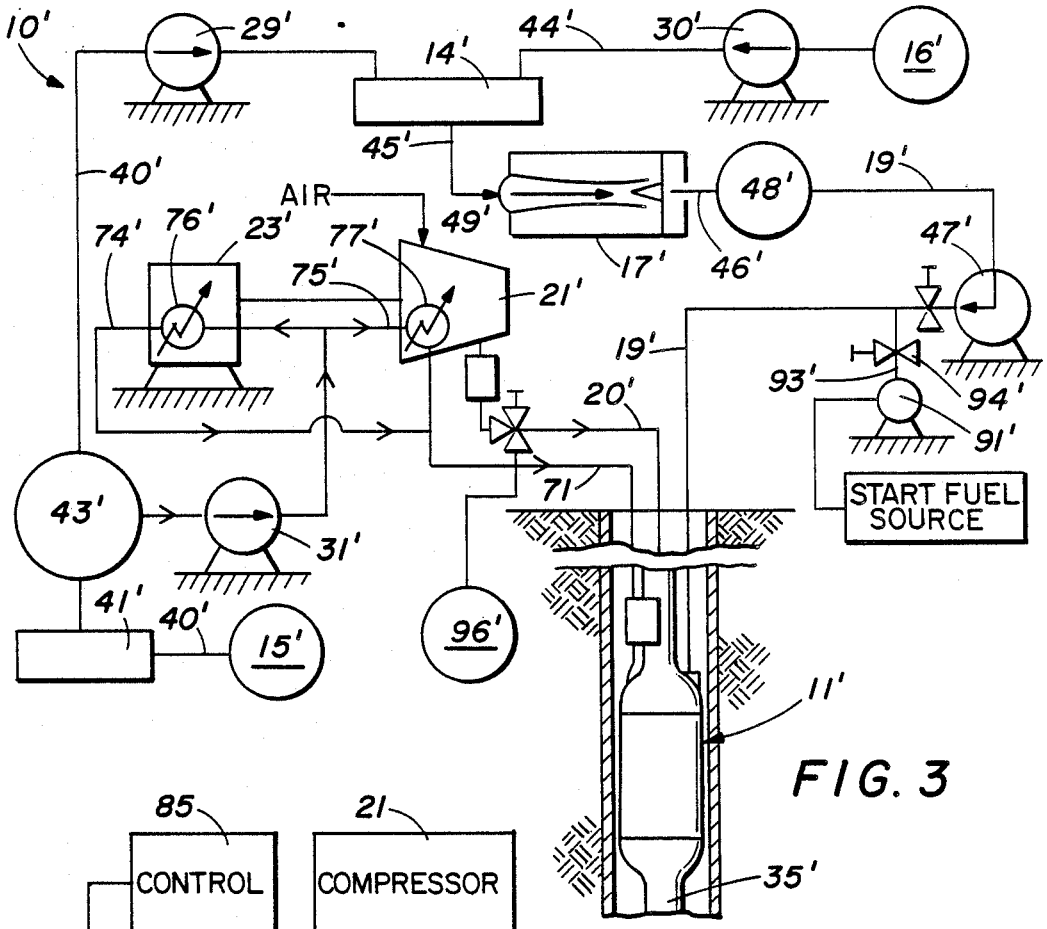
FIG. 3 is an alternative embodiment of a steam generating system embodying the novel features of the present invention.
Figure 4:
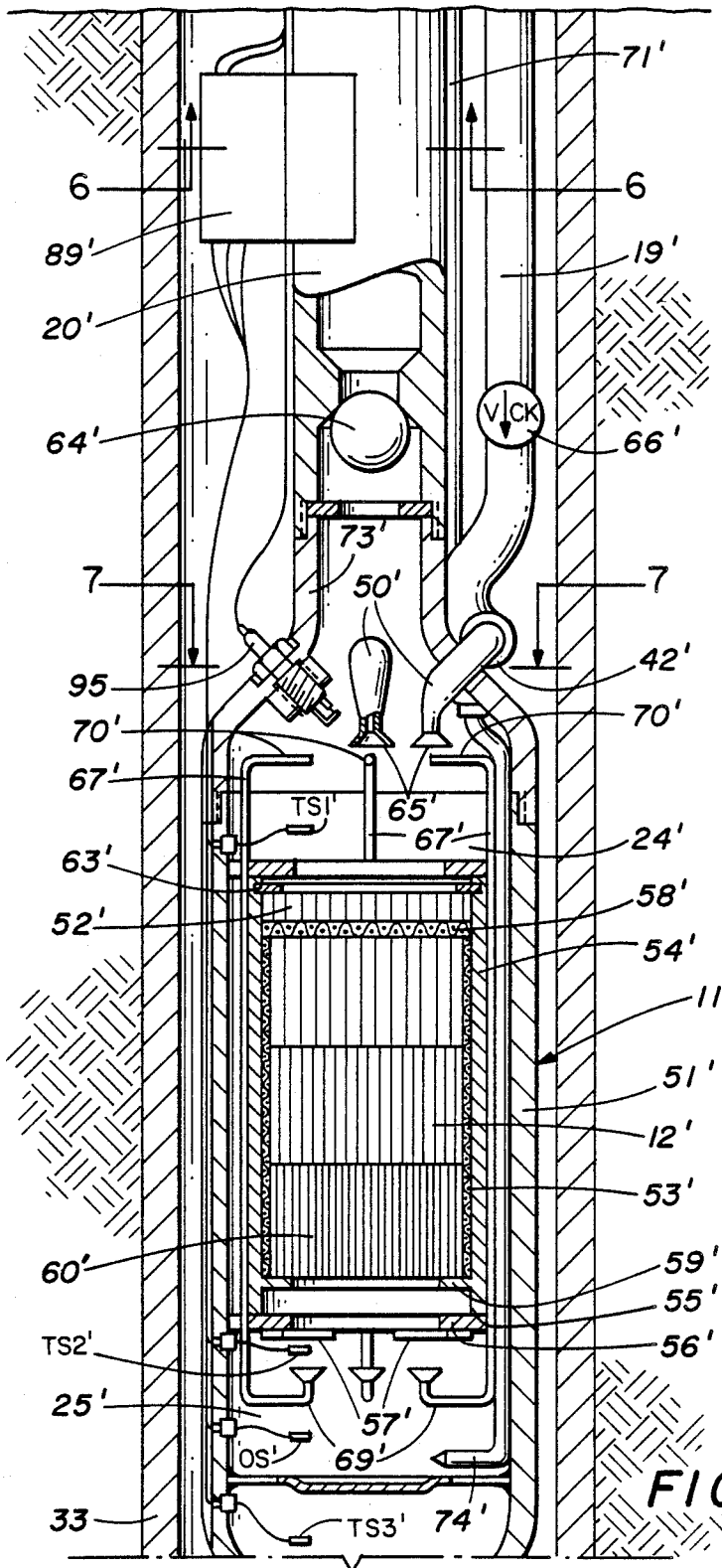
FIGS. 4 and 5 comprise a combined cross-sectional view of the combustor utilized in the alternative system shown in FIG. 3.

Two exemplary embodiments of the present invention are disclosed herein and both are related to the use of steam for enhanced oil recovery. The first embodiment (FIGS. 1 and 2) to be described contemplates location of the combustor 10 on the earth's surface such as at the head of a well to be treated. Although the system of this first embodiment illustrates treatment of only one well the system could be adapted easily to a centralized system connected to treat multiple wells simultaneously. A second embodiment contemplated for downhole use is shown in FIGS. 3 and 4 with parts corresponding to those described in the first embodiment identified by the same but primed reference numbers. The fuel-mixture and controls for the two different embodiments are virtually identical. Accordingly, the description which follows will be limited primarily to only one version for purposes of brevity with differences between the two systems identifed as may be appropriate, it being appreciated that the basic description relating to similar components in the two systems is the same.

As shown in FIG. 1, the first embodiment of the system contemplated by the present invention includes a mixer 14 wherein water from a source 15 and fuel oil from a source 16 are mechanically mixed in a calculated mass ratio for delivery to a homogenizer 17. The homogenizer forms the fuel-mixture as an emulsion for delivery through a line 19 to the combustor 11 for combustion. Air containing stoichiometric quantities of oxygen is delivered through another line 20 to the combustor 11 by means of a compressor 21 driven by a prime mover 23. Within the combustor (see FIG. 2), the emulsified fuel-mixture and air are mixed intimately together in an inlet chamber 24 to form the burn-mixture before flowing into the combustion zone 13 of the combustor. In the presence of the catalyst 12, the carbonaceous fuel contained within the burn-mixture is combusted directly heating the water therein to form a heated fluid comprised of super heated steam and the products of such combustion. Upon passing from the catalyst the heated fluid flows into a discharge chamber 25 wherein additional water from the source 15 is injected into the fluid to cool it prior to exiting the combustor. From the discharge chamber, the heated working fluid (steam) exits the combustor through an outlet 26 connected with tubing 35 leading into the well. Downhole, a packer 34 seals between the tubing and the interior of the well casing 33 and the tubing extends through the packer to a nozzle 32 particularly designed for directing the steam outwardly into an oil bearing formation through perforations in the casing.

Herein, the nozzle comprises a series of stacked frusto conical sections **32*a* held together by angularly spaced ribs 32*b*. Preferably, the space between the walls of adjacent sections are shaped as diffuser areas to recover at least some of the dynamic pressure in the steam so as to help in overcoming the natural formation pressure which resists the flow of steam into the formation. In the embodiment illustrated in FIG. 1 in order to recover some of the heat that might otherwise be lost by radiation from the tubing string 35 toward the well casing 33, inlet air to the compressor 21 through the line 20 is circulated through the annulus 18 surrounding the tubing string above the packer 34 to preheat the air somewhat before entering the compressor. At the top of the casing, an outlet line 22 from the compressor extends into the well through the well head with an open lower end 37 of the line located just above the packer 34. Air from the compressor exits the lower end 37 of the line and flows upwardly within the annulus 18 to exit the well through an upper outlet opening 39 at the well head connecting with the inlet line 20 to the combustor. In the downhole version of the present invention, the combustor 11' (see FIGS. 3 and 4) the compressor outlet line 20' connects at the well head to the upper end of tubing string 35' with the combustor 11' being connected to the lower end of the tubing string just above the packer 34'**.

Figure 8:
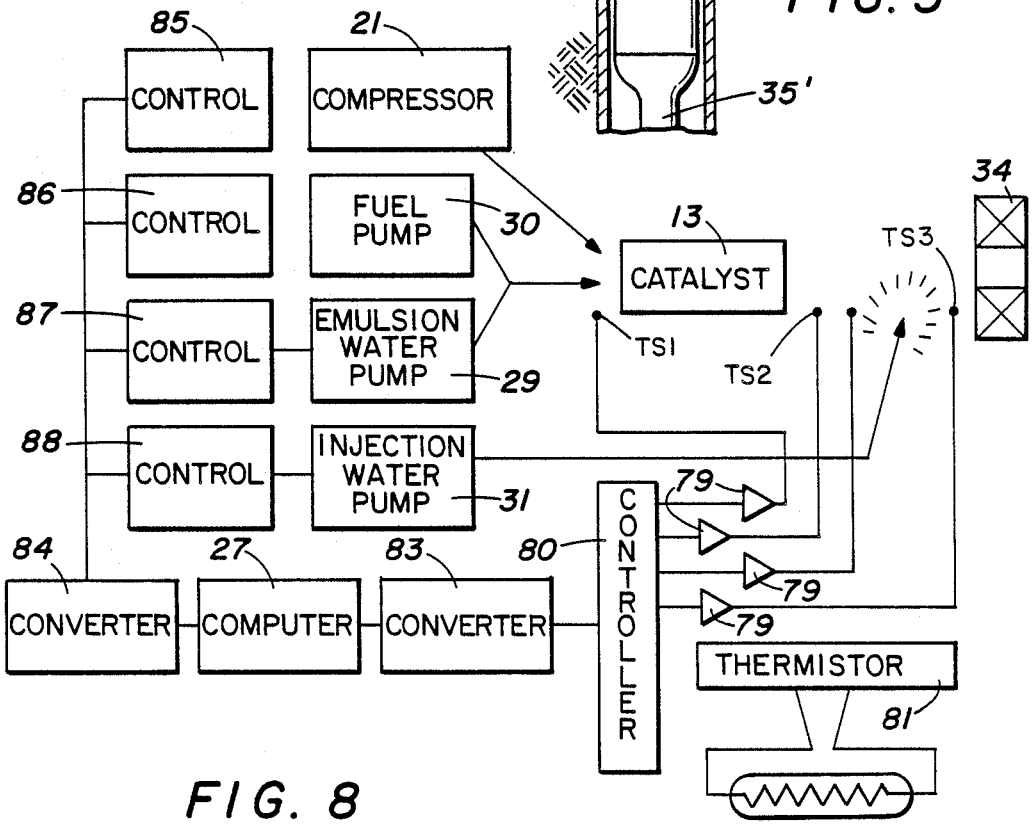
FIG. 8 is a schematic diagram of the controls utilized in the exemplary systems.

For controlling both the ratio of water to fuel in the fuel-mixture and the ratio of fuel-mixture and air relative to stoichiometric, control sensors (FIG. 2) including temperature sensors TS1, TS2, and TS3 and an oxygen sensors OS are provided in the combustor 11. Temperature sensor TS1, TS2 and TS3 are located in the inlet chamber 24, in the discharge chamber 25 ahead of the post injection water, and in the discharge chamber 25 beneath the post injection water, respectively, while the oxygen sensor OS is located in the discharge chamber. A schematic of this arrangement is shown in FIG. 8 wherein signals from the control sensors are processed in a computer 27 and latter is used to control the amount of air delivered by the compressor 21 to the combustor, pumps 29 and 30 in delivering relative quantities of water and fuel to the homogenizer 17 and the amount of water delivered by the post injection water pump 31.

As previously mentioned, several significant advantages are attained by combusting in accordance with the present invention. High thermal efficiency is attained, mechanical efficiency of system components is increased and virtually pollution free production of steam is accomplished at low combustion temperatures all with a fuel-mixture which does not combust thermally under normal conditions. Moreover, use of the fuel-mixture results in a boilerless production of steam by directly heating the water in the mixture with the heat generated by the combustion of the fuel in the mixture. Herein, one fuel-mixture contemplated comprises a mass ratio of water to fuel of 5.2:1 for deionized water and number two fuel oil and, with stoichiometric quantities of air of about 2430 scfm passing over the catalyst 12, catalytic combustion of the fuel will produce an adiabatic flame temperature of approximately 1700° F. without an application of preheat from some external source. Other carbonaceous fuels which may be used in producing an acceptable fuel-mixture advantageously include those highly viscous oils which otherwise have only limited use as combustion fuels. In one early test, a topped crude oil, specifically Kern River heavy fuel oil, of approximately 13° API was formed as an emulsion with water and was combusted catalytically to directly heat the water in the emulsion ultimately to produce steam at a temperature of 1690° F. with a carbon conversion efficiency of 99.7%. In that test, the mass ratio of water produced in the form of steam, including the products of combustion, to fuel combusted was 14:1.

Although perhaps steam may be the most desirable working fluid produced by combustion in accordance with the present invention, it will be appreciated that the inventive concept herein extends to the direct heating of a diluent as a result of combustion of a carbonaceous fuel mixed intimately with the diluent. The characteristics of the diluent that are important are, that the diluent have a high heat capacity, that it be a non-combustible, that it be useful in performing work, and that it give the fuel-mixture a theoretical adiabatic flame temperature which is below the upper temperature stability limit of the catalyst. The latter is of course important to keep the catalyst or its support from being sintered, melted or vaporized as a result of the heat generated during combustion of the fuel portion of the mixture. Having a high heat capacity is important from the standpoint of thermal efficiency in that relatively more heat is required to raise the temperature of the diluent one degree over other substances of equal mass. Herein, any heat capacity generally like that of water or above may be considered as being a "high heat capacity". Additionally, it is desirable that the diluent be able to utilize the heat of combustion to go through a phase change. With most of these characteristics in mind, other chemical moieties that may be acceptable diluents include carbon dioxide.

In selecting the mass ratio of diluent to fuel in the fuel-mixture, both the heat of combustion of the fuel and the upper and lower temperature stability limits of the catalyst 12 are taken into consideration. The lower stability limit of the catalyst, herein is that low temperature at which the catalyst still efficiently causes the fuel to combust. Accordingly, for each type of catalyst that may be suitable for use in the exemplary combustor 11, some acceptable range of temperatures exists for efficient combustion of the fuel without causing damage to the catalyst. A selected temperature within this range then respresents the theoretical adiabatic flame temperature for the fuel-mixture. Specifically, the ratio of the diluent, or water as is contemplated in the preferred embodiment, to fuel is set by the heat of combustion (that amount of heat which theoretically is released by combusting the fuel) and is such that the amount of heat released is that which is necessary to heat up both the diluent and the products of combustion to the aforementioned selected temperature. This temperature, of course, is selected to maximize the performance of useful work by the working fluid produced from the combustor 11 given the conditions under which the working fluid must operate. Stated more briefly, the ratio of the diluent to the fuel is the same as the ratio of the heat capacity of the diluent plus the heat capacities of the products of combustion relative to the heat of combustion of the fuel utilized in the combustor.

The system for providing the fuel-mixture to the combustor 11 is shown schematically in FIG. 1 with a schematic representation of the controls utilized in regulating the mass ratio of the fuel-mixture shown in FIG. 8. While the system shown in FIGS. 1 and 8 illustrates the various components thereof as being connected directly to each other, it should be recognized that the functions performed by some of the components may be performed at a site remote from the combustor 11.

More particularly, the water source 15 of the exemplary system 10 is connected by a line 40 to a deionizer 41 for removing impurities from the water which may otherwise foul or blind the catalyst 12. From the deionizer, the line 40 connects with a storage tank 43 from which the deionized water may be drawn by pumps 29 and 31 for delivery ultimately to the combustor 11. The pump 29 connects directly with the mixer 14 through the line 40 and a branch line 44 connects the mixer with the fuel pump 30 for the mixer to receive fuel from the fuel source 16. The deionized water and fuel are delivered to the mixer 14 in relative quantities forming an admixture whose proportions are equal to the aforementioned thermally self-extinguishing mass ratio. At the mixer, the two liquids are stirred together for delivery through an outlet line 45 to the homogenizer 17 where the two liquids are mixed intimately together as an emulsion to complete the mixing process. From the homogenizer, the admixture emulsion is transferred to an intermediate storage tank 48 through a line 46 and a pump 47 connecting with the latter tank provides the means by which the emulsion or fuel-mixture may be delivered in controlled volume through the line 19 connecting with the combustor 11.

While the preferred embodiment of the present invention contemplates a system 10 in which the fuel-mixture is formed as an emulsion which is fed without substantial delay to the combustor 11 for combusting the fuel in the mixture, in instances where greater stability in the emulsion may be desired, various chemical stabilizing agents including one or more nonionic surfactants and a linking agent, if desired, may be used to keep the emulsion from separating. In the aforementioned Kern River heavy fuel oil, the surfactants "NEODOL 91-2.5" and "NEODOL 23-6.5" manufactured by Shell Oil Company were utilized with butylcarbitol. In other instances, with suitable nozzles in the inlet chamber 24 of the combustor 11, the water and fuel may be sprayed from the nozzles in a manner sufficient to provide for adequate mixing of the water, fuel and air for proper operation of the catalyst 12. With this latter type of arrangement, the need for the homogenizer 17 may be avoided.

For combustion of the fuel-mixture in the combustor 11, oxygen is provided by air delivered by the compressor 21 to the combustor 11 through the line 20. Specifically, the compressor draws in air from the atmosphere through an inlet 49 and pumps higher pressure air to the combustor through the line 22, the annulus 18 and the line 20 to the combustor. At the combustor the line 20 connects to the inlet chamber 24 through the housing 51 and the fuel-mixture is delivered through line 19. The latter connects with the housing through an intake manifold 42 (see FIG. 2) which in turn communicates with the inlet chamber 24 through openings 50 in the combustor housing 51. Upstream of the manifold 42 within the line 19, a pressure check valve 66 is utilized to keep emulsion from draining into the catalyst before operational pressure levels are achieved. Similarly, a check valve 64 is located in the line 20 to keep air from flowing into the inlet chamber 24 before operational pressure levels are achieved. Within the inlet chamber 24, a fuel-mixture spray nozzle 65 is fixed to the inside of housing around each of the openings 50 and, through these nozzles, the emulsion is sprayed into the inlet chamber 24 for the fuel mixture to be mixed thoroughly with the air to form the burn-mixture. The burn-mixture then flows through a ceramic heat shield 52. Following the heat shield is a nichrome heating element 58 for initiating combustion of a start-fuel mixture in the well head system. In the downhole version, the burn mixture also flows past an electrical starter element 95 before flowing through the catalyst 12 for combustion of the fuel. In both the surface generator and the downhole generator, the catalyst 12 is a graded cell monolith comprised of palladium with platinum on alumina supported on material such as cordierite and operates at a temperature below the thermal combustion temperature for number two diesel fuel.

Figure 2:
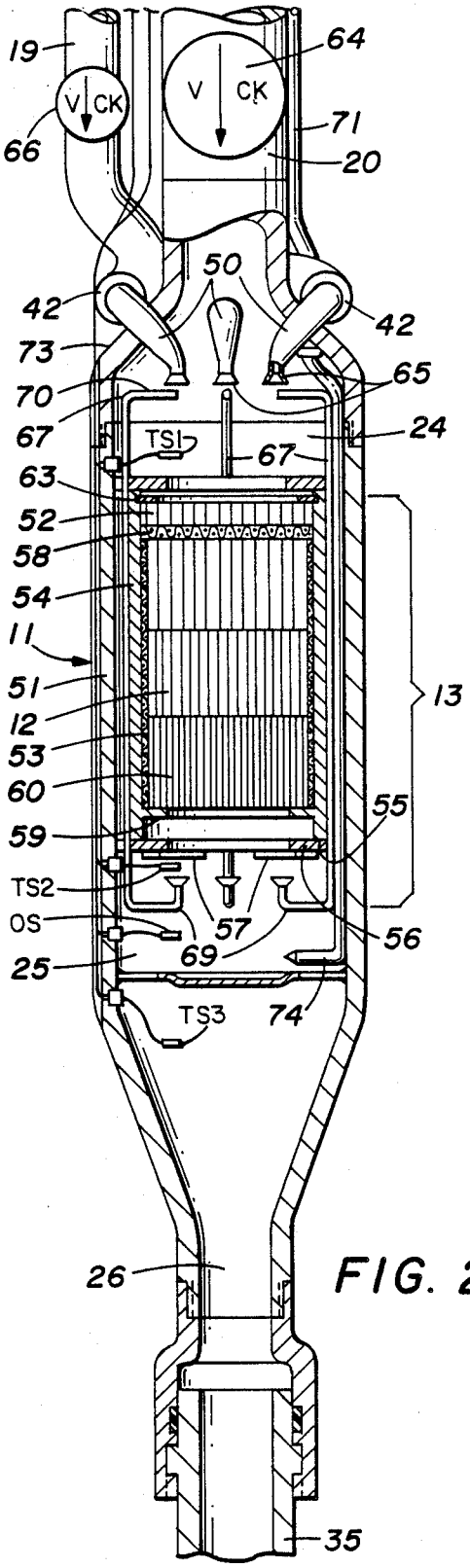
FIG. 2 is a cross-sectional view of the combustor utilized in the exemplary sytem shown in FIG. 1.
Figure 6:
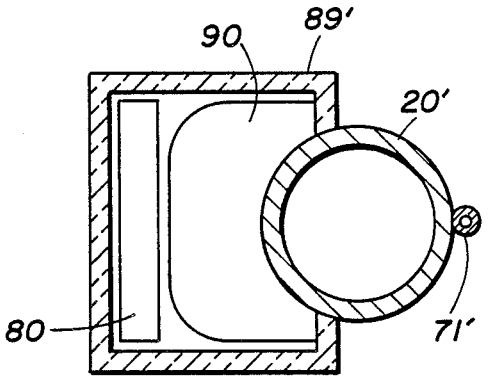
FIGS. 6 and 7 are cross-sectional views taken substantially along lines 6—6, and 7—7 of FIG. 4.
Figure 7:
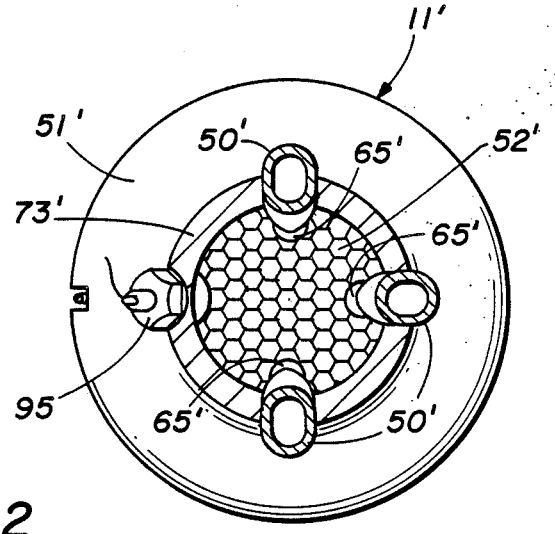

As shown more particularly in FIG. 2, the catalyst 12 in the combustor 11 is generally cylindrical in shape and is supported within the combustor housing 51 by means of a series of concentric cylindrical members including a thermal insulating fiberous mat sleeve 53 surrounding the catalyst to support the catalyst against substantial movement in a radial direction while still allowing for thermal expansion and contraction. Outside of the sleeve is a monolith support tube 54 whose lower end 55 abuts a support ring 56 which is held longitudinally in the housing by means of radial support projections 57 integrally formed with and extending inwardly from the combustor housing. Inwardly extending support flanges 59 integrally formed with the inside surface of the support tube abut the lower end of the bottom cell 60 of the catalyst to support the latter upwardly in the housing 51. At the upper end of the support tube 54, a bellville snap ring 63 seats within a groove to allow the monolith to expand and contract while still providing vertical support.

In catalytically combusting the fuel, the temperature of the burn-mixture as it enters the catalyst 12 must be high enough for at least some of the fuel in the mixture to have vaporized so the oxidation reaction can take place. This is assuming that the temperature of the catalyst is close to its operating temperature so that the vaporized fuel will burn thereby causing the remaining fuel in the burn-mixture to vaporize and burn. Thus it is desirable to preheat either the fuel-mixture or the air or the catalyst to achieve the temperature levels at which it is desirable for catalytic combustion to take place.

In accordance with one advantageous feature of the present invention, preheating is achieved by utilizing some of the heat generated during combustion. For this purpose, a device is provided in the combustor between the inlet and discharge chambers 24 and 25 for conducting some of the heat from combustion of the fuel to at least one of the components of the burn-mixture so as to preheat the fluids entering the catalyst 12. Advantageously, this construction provides adequate preheating for vaporization of enough of the fuel to sustain normal catalytic combustion of the burn-mixture without need of heat from some external source. Moreover, this allows for use of heavier fuels in the burn-mixture as the viscosity of such fuels lowers and their vapor pressures increase with increasing temperature.

In the present instance, the device for delivering preheat to the burn-mixture prior to its entering the catalyst 12, includes four angularly spaced tubes 67 communicating between the combustor inlet and discharge chambers 24 and 25 (see FIG. 2). The tubes are located within the combustor housing 51 between the inside wall of the housing and the outside of the catalyst support tube 54. Opposite end portions 69 and 70 of each of the tubes 67 are bent to extend generally radially inward with the lower end portions 69 being also flared upwardly so that hot combustion gases from the discharge chamber 25 may first flow downwardly and then radially outward through the tubes. Thereafter, the hot combustion gases, including some steam flow upwardly through the tubes and at the upper end portions 70 thereof flow radially inward to mix with the fuel-mixture and air within the inlet chamber 24. The heat in this discharge fluid thus provides the heat necessary for raising the temperature of the fluids in the inlet chamber preferably to the catalytic instantaneous ignition temperature of the resulting burn-mixture. The number of, the internal diameter of, and the inlet design of, the flow tubes at least to some extent determines the rate at which heat may be transferred from the discharge chamber back to the inlet chamber.

This unique preheat construction relies upon what is believed to be the natural increase in pressure of the products of combustion (steam and hot gases) over the pressure of the fluid stream passing through the catalyst 12 in order to drive heat back to the inlet chamber 24. This may be explained more fully by considering the temperature profile (see FIG. 12) of the combustor 11. Because the temperature profile for a constant volume of gas can be translated directly into a dynamic pressure profile, it may be seen that the temperature of the fluid stream passing through the catalyst rises as combustion occurs. As shown in the profile, the temperature, $T_{fs}$, of the fluid stream rises slightly and then decreases as the emulsion passes through the spray nozzles 65 which are located at the point A in the temperature profile. Feedback heat F enters at the point B on the profile to keep the temperature from falling further due to the sudden drop in pressure as the fuel-mixture is sprayed from the nozzles. The point C on the profile indicates the beginning of catalytic combustion which is completed just prior to the point D. Throughout the catalyst 12 the temperature of the fluid stream flowing therethrough first increases sharply and then levels off as combustion of the fuel in the fluid stream is completed. At point E, additional water is injected into the heated products of combustion and the super heated steam exiting the catalyst to bring down the temperature of this fluid mixture before performing work. Although the foregoing arrangement for direct preheating the burn-mixture prior to entering the catalyst is thought to be particularly useful in the exemplary combustor, other methods of preheating such as by indirect contact of the burn-mixture with the exhaust gases (such as through a heat exchanger) or by electrical preheaters also may be acceptable methods of preheating. Additionally, it will be recognized herein that some of the radiant heat absorbed by the heat shield 52 will be absorbed by the burn-mixture as it passes through the shield to also help in preheating the burn-mixture.

For the post combustion injection of water into the heated fluid stream produced by the combustor 11, a water supply line 71 (see FIGS. 1 and 2) is connected through an end 73 of the housing 51 and extends into the discharge chamber 25. A nozzle end 74 of the line directs water into the flow path of the heated fluid stream exiting the catalyst 12. To deliver the injection water to the combustor, the pump 31 communicates with the storage tank 43 of the deionized water and circulates this cooler water through loops 74 and 75 connecting with heat exchangers 76 and 77 in the prime mover and compressor, respectively, to absorb heat that otherwise would be lost from the system by operation of these two devices. This water then is delivered through line 71 to the combustor 11 for post injection cooling of the super heated steam exiting the catalyst.

In accordance with another important feature of the present invention, the relative mass flow of diluent or water to fuel is regulated to obtain a fuel-mixture which herein is an admixture whose theoretical adiabatic flame temperature for catalytic combustion is above the light-off temperature of the catalyst 12 and below the upper stability limit temperature of the catalyst and its support. For these purposes, the exemplary system includes sensor means including the temperature sensor TS2 for determining the temperature $T_2$ of the heated fluid stream exiting the catalyst 12 and control means responsive to such sensor. The control means regulate the proportions of diluent and fuel in the burn-mixture so that, if combusted with theoretical quantities of oxidant, the temperature of the resulting fluid stream theoretically is the aforesaid specified temperature. Advantageously, with this arrangement the thermal efficiency of the combustor is maximized and losses in mechanical efficiency resulting from otherwise excessive pumping are minimized.

In the present instance, a schematic illustration of the exemplary system controls is shown in FIG. 8 and includes the thermocouples TS1, TS2 and TS3 for detecting the temperature $T_1$ within the catalyst inlet chamber 24, the temperature $T_2$ at the outlet end of the catalyst 12 prior to post combustion water injection and the temperature $T_3$ of the steam discharged from the combustor 11. Additionally, the oxygen sensor OS disposed within the discharge chamber 25 serves to detect the presence of oxygen in the heated fluid stream to provide a control signal to aid the computer 27 in controlling combustion relative to stoichiometric. More specifically, signals representing the temperatures $T_1$, $T_2$, $T_3$ and oxygen content are processed through suitable amplifiers 79 and a controller 80 before entering the computer. The temperature signals are processed relative to a reference temperature provided by a thermistor 81 to obtain absolute temperatures. Thereafter, both the temperature and oxygen content signals are fed to an analog to digital converter 83 for delivery to the computer 27 to be at least temporarily stored within the computer as data. This information along with other information stored in the computer is then processed to provide output signals which are fed through a digital to analog converter 84 to provide appropriate control signals for controlling flow regulating devices 85, 86, 87, 88 for the air compressor 21, the emulsion water pump 29 and the fuel pump 30, and the injection water pump 31, respectively. As the temperatures $T_1$, $T_2$ and $T_3$ and oxygen content of the heated fluid stream may vary during the course of operation of the combustor 11, the data fed into the computer 27 changes resulting in the changes being made in the output signals of the computer and in turn the control signals controlling the proportions of flow in the components of the fuel and the air forming the burn-mixture.

As shown in FIGS. 2 and 4, the thermocouples TS1, TS2, and TS3 and the oxygen sensor OS are connected by leads through the housing 51 of the combustor 11 and to box 89 containing the controller 80. In the well head system shown in FIGS. 1 and 2, the box 89 is mounted adjacent the combustor housing 51. In the downhole system shown in FIGS. 34*a* and 46, the insulated box 89' is hermetically sealed to the tubing string 35' which connects with the top 73' of the combustor housing 51. Heat conducting fins 90 mounted within the box 89' are connected with the tubing 35' so that the air flowing through the tubing may be utilized to maintain a standard temperature within the box for proper operation of the thermistor 81'.

Part of the information providing a data base for the computer 27, is illustrated graphically in FIG. 13 which shows general combustor temperature curves at varying air-fuel ratios for three different fuel admixtures. For example, curve I represents the temperature of the fluid stream produced by combustion of an emulsion having a water to fuel ratio of 5.2 with different air-fuel ratios and curve II represents the temperature of heated fluid stream produced by combination of an emulsion having a mass ratio of water to fuel of 6.2. The water to fuel ratio associated with curve III is even higher. The peak temperature for each curve occurs theoretically when the air to fuel-admixture ratio is stoichiometric. The vertical line "S" in the graph represents generally the stoichiometric ratio of air to fuel-admixture. As may be seen from the curves, when there is excessive fuel for the amount of air (a rich mixture) the temperature of combustion is lower than the peak temperature for the particular mass ratio being combusted. Similarly, if there is excessive air, the temperature also drops. Moreover, it is seen that as the water content of the fuel-admixture increases, the peak temperature decreases, the water serving to absorb some of the heat of combustion. While the curves illustrated in FIG. 13 show different fuel-admixtures, the heating valve of the fuel portion of each of the admixtures is the same. For fuels having different heating valves, the temperatures of combustion for equal mass ratios of admixture utilizing such different fuels will vary from one fuel to next. Accordingly, the data base of the computer is provided with comparable information for each fuel to be used.

Figure 9:
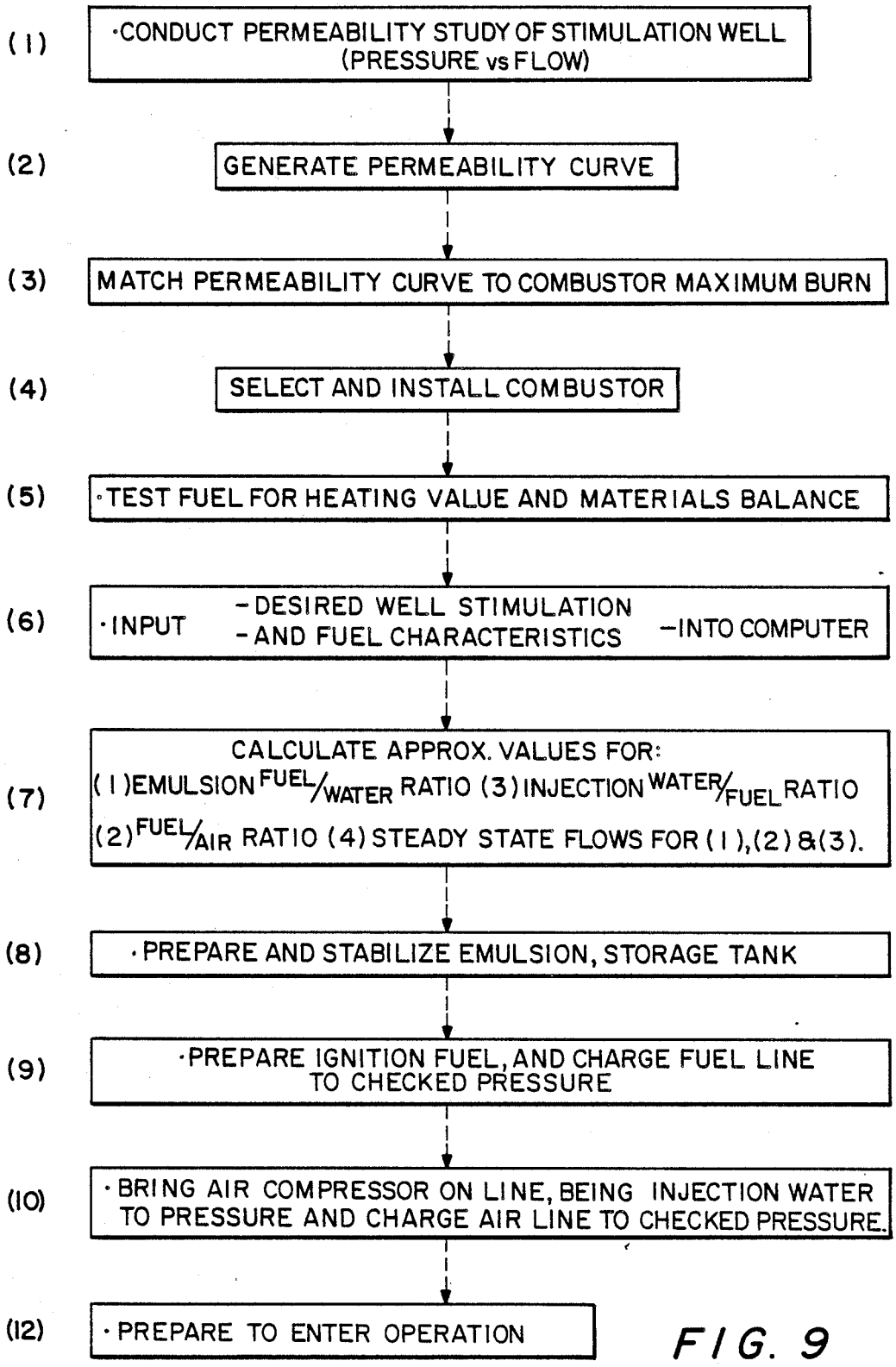
FIGS. 9, 10, 11 and **11*b*** are flow diagrams of steps performed in the operation of the exemplary steam generating systems.

In addition to the foregoing information, the data base of the computer 27 is provided with specific information including that resulting from performing preliminary processing steps performed to obtain information unique to each end use contemplated for the combustor's heated output fluid. An example of such is shown in outline form in FIG. 9 such as when preparing the combustor for use in steam flooding an oil bearing formation.

Generally speaking, the physical characteristics of each oil bearing formation are unique and such characteristics as permeability, porosity, strength, pressure and temperature affect the ability of the formation to accept steam and release oil. Accordingly, oil from different oil bearing formations may be produced most efficiently by injection of steam at different flow rates, pressures and temperatures dependent upon the formation's ability to accept flow and withstand heat and pressure without being damaged.

In accordance with one of the more important aspects of the present invention, the exemplary combustor 11 may be used to produce oil from oil bearing formations which have substantially different physical characteristics by providing a heated working fluid over a wide range of heat release rates, pressures and temperatures so as to best match the needs of a formation for efficent production of oil from that formation. Briefly, this is derived by first testing the formation to be produced to determine the desired production parameters such as pressure, heat release rate and temperature and then matching the combustor output to these parameters by operating the combustor in a particularly novel manner to provide a heated working fluid output matching these conditions. Inititally, this is done by selection of the combustor catalyst size which provides the widest combustor operating envelope within desired production parameters for the formation. Then, during combustor operation, the flow of air, fuel and diluent advantageously may be adjusted to precisely achieve the output characteristics desired even if these characteristics may change because of changes in the formation characteristics due to the induced flow of fluids through the formation. Thus, for example, the heat release rate of the combustor may be adjusted by changing the rate of flow of the carbonaceous fuel through the catalyst without affecting the temperature of the working fluid by making corresponding changes in the diluent and air flowing through the combustor. Advantageously, this may be effected over a substantially wide range of heat release rates by selectively proportioning the total water flowing through the combustor between that water which is added to the fuel to make the fuel-mixture and that which is injected subsequent to combustion so as to maintain a flow of the burn-mixture over the catalyst within a range of space velocities at which efficient combustion of the fuel takes place.

When using the exemplary system in a steam flooding operation, the amount of air to be pumped into the combustor 11 for oxidizing the fuel may be established theoretically by conducting a permeability study of the well which is to receive the steam. Preferably, this is done utilizing nitrogen gas which may be provided from a high pressure source (not shown) to generate empirically a reservoir injectivity curve unique to the formation to be flooded. The use of nitrogen gas is preferred over air so as to avoid forcing oxygen into the formation and risking the possibility of fire in the formation. Available calculational techniques employed by petrolum engineers enable conversion of the flow and pressure data obtained using nitrogen into similar data for the heated fluid stream produced by the combustor. With this latter data, a theoretical injectivity curve (See FIG. 14) for the formation may be generated for selecting the dimensions of the catalyst 12 used in the combustor 11 in order to obtain a maximum heat release rate and steam flow for the combustor.

Figure 15:
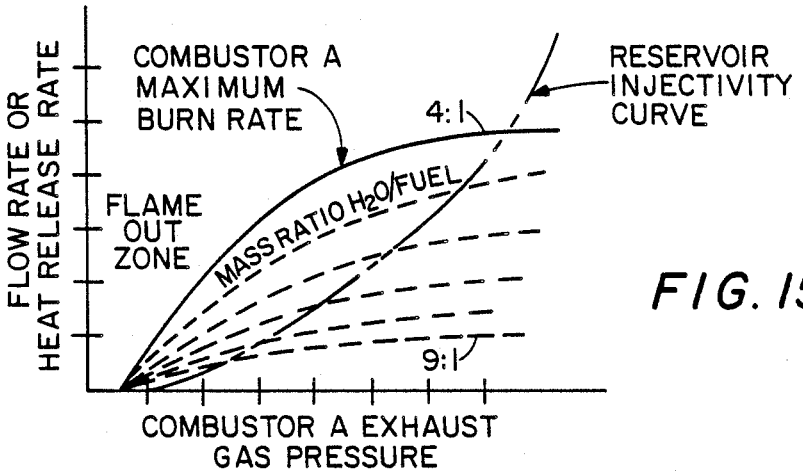
FIGS. 15 and 16 are maximum burn rate curves for different fuel-mixtures for a combustor equipped with catalysts of two different sizes; with the curve of FIG. 15 matched with the injectivity curve of FIG. 14.
Figure 16:
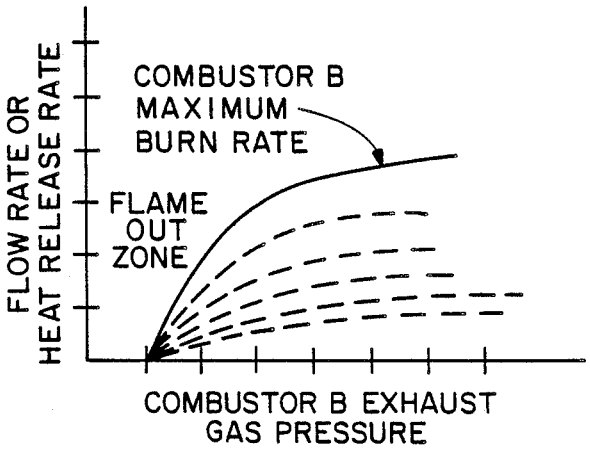
Figure 17:
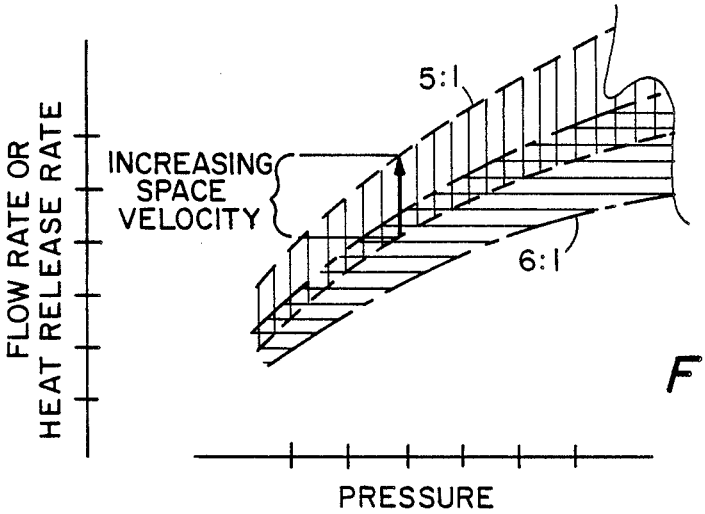
FIG. 17 is an enlarged section of the curve shown in FIG. 15 illustrating the overlapping operative ranges of the combustor for fuel-mixtures having different water: fuel mass ratios.

As shown in FIGS. 15 and 16, different sizes of catalyst 12 perform most efficiently at different heat release rates and pressures. FIG. 15 illustrates a representative maximum burn rate curve for combustor A having one size of catalyst while FIG. 16 illustrates a second representative maximum burn rate curve for combustor B having another size of catalyst. The physical dimensions, largely diameter and length, of the catalysts determine the lopes of these maximum burn rate curves for each stoichiometric burn-mixture while the rates of combustion are functions of the mass flow of the burn-mixture and the pressure at which the burn-mixture is passed over the catalyst. The area above the curves in these two figures represents a flame out zone within which the rate of flame propogation for the burn-mixture being combusted is less than the space velocity of the burn-mixture through the catalyst. The family of curves represented by the dashed lines in each graph illustrates fuel mixtures having different mass ratios of water to carbonaceous fuel with the curve of FIG. 15 illustrating representative mass ratios ranging from 9:1 to 4:1. In actuality, the dash lines of the maximum burn rate curves represent the center of the combustion envelope within which the particular fuel-mixture may be combusted at a given pressure over a range of heat release rates and space velocities. A representative section of a maximum burn rate curve is shown in FIG. 17 for fuel-mixtures having mass ratios of 5:1 and 6:1 with the shaded cross-hatching representing the areas at which combustion of the mixtures may occur. As may be seen from this enlargement, the areas of combustion for these different mass ratios of water to fuel overlap each other.

To select the proper combustor for efficient thermal combustion under the operating conditions expected, the combustor chosen is the one whose combustor maximum burn curve most closely matches the injectivity curve of the formation. Matching is done to provide the combustor with the widest range of operating envelope for the desired flow and pressure at which the steam is to be injected into the formation. Advantageously then, as formation conditions change during operation the combustor can be adjusted to compensate for the changes and still provide the output desired.

Once the proper size of catalyst 12 has been chosen and the catalyst is installed in the combustor housing 51, then the combustor 11 may be connected with the well for delivery of steam to the formation for steam flooding purposes. But, before steam flooding a test is made of the fuel to be combusted to determine its actual heating valve, and calculations performed to determine if the heat and materials balance for the burn-mixture selected using this fuel check theoretically across the combustor within the range of operating temperatures ($T_{2min}$, $T_{2max}$) for the combustor utilizing the selected size of catalyst. Assuming the fuel test is satisfactory, the information as to desired heat release rate, maximum combustor outlet temperature $T_3$ of the steam, maximum combustion temperature, $T_{2max}$, and steam pressure is fed as imput data into the computer 27 for use in controlling operation of the combustor during start-up, shut down and steady state operations. Also, calculations are performed to obtain estimated values for the mass ratio of the fuel-mixture, the fuel/air ratio, the ratio of injection water to fuel, and the steady-state flow rates for the fuel-mixture air and injection water. From these figures, the flow regulating devices 85, 87, 86 and 88 associated with pumps 29, 30, and 31, respectively, may be set to provide the desired flow rates of fuel, water and air to the combustor. The flow rates for all of these fluids are first determined as estimated functions of the empirically established flow of nitrogen gas into the formation. Given the temperature data for the burn-mixture being combusted in accordance with the curves as illustrated in FIG. 13, these flow values may be established so as to have a theoretical stoichiometric combustion temperature within the aforesaid temperature range represented by the stability limits of the catalyst 12.

With the emulsion prepared at the proper mass ratio of water to carboneacous fuel and the fuel, air and water supply lines 19, 20 and 71 leading to the combustor 11 charged to checked pressure, the combustor is ready to begin operation. The flow chart representing operation of the combustor is shown generally in FIG. 10 with a closed looped control for steady state combustion (step 20 FIG. 10) being shown in FIGS. 11*a* and 11*b*. The closed loop control for start-up of combustion (step 15 FIG. 10) is substantially the same as that for steady state operation except that the data base information to the computer 27 is characterized particularly as to the start fuel utilized. Accordingly, the specific description of the start-up control loop is omitted with the understanding that such would be substantially the same as the subsequently described steady state operation.

Upon entering operation (step 12), preignition flow rates are established in the fuel, air and water supply lines 19, 20, and 71, respectively opening the check valves 66 and 64 to cause ignition fuel and air to be delivered to the combustor 11 (step 13). In the surface version of the exemplary system, ignition (step 14) of the fuel is accomplished through the use of an electrical resistance igniter 58 located above the upper end of the catalyst 12 (see FIG. 2) while in the downhole version, the use of a glow plug 95 also is contemplated as an electrical starting means. Once the ignition fuel begins to burn, closed loop control (steps 15–17) of the ignition cycle continues until the combustion becomes stable. If the ignition burn is unstable after allowing for sufficient time to achieve stability, a restart attempt is made automatically (see FIG. 10 steps 12–16). Once stability is achieved in the ignition cycle, the steady state fuel for the fuel-mixture is phased in (step 18) with the system being brought gradually up to a steady state burning mode. As steady state burning continues, control of the combustor is maintained as is set forth in the closed loop control system illustrated in FIGS. 11*a* and 11*b*. In the closed loop control, the thermalcouples TS1, TS2, and TS3 detect the temperatures within the inlet chamber 24, the discharge chamber 25, and the combustor outlet 26 and this information is fed to and stored in the computer 27 (see FIG. 11*a* sub-step A). Additionally, information as to the flow rates of the fuel-mixture, air and injection water are stored in the computer and heat and materials balances for the combustor system are calculated (sub-step B) using actual temperature data. Two heat and materials balances are computed, one for the overall system utilizing the actual output temperature $T_{3a}$ and one internal balance utilizing the catalyst discharge temperature or combustion temperature $T_2$. This information is utilized to assure proper functioning (sub-step C) of the various sensors in the system. If the sensors are determined to be functioning properly, then the system variables (water flow, fuel flow, and air flow) are checked to make sure that they are within limits (sub-step F) to assure proper functioning of the combustor without damage being caused by inadvertently exceeding the stability limits of the catalyst 12 and the maximum temperature and heat release rates at which steam may be injected into the formation. If the variables outside of the safety limits for the system, then the system is shut down. If the variables are within their limits, the computer analyzes the inputed temperature and fluid flow data to calculate the actual heat release rate of the combustor and compare it to the desired level to be fed into the formation being treated (sub-step G). If the actual heat release rate requires changing to obtain the heat release rate desired, the flow rates of the fuel-mixture, air and injection water are adjusted proportionally higher or lower as may be necessary to arrive at the desired heat release rate. Once the heat release rate is as desired, a comparison of the actual temperature ($T_{3a}$) of the heated working fluid discharged by the combustor to the set point temperature ($T_{3sp}$) for such fluid is made. Depending upon the results of this comparison, the amount of injection water sprayed into the heated fluid is either increased or decreased to cause the actual temperature ($T_{3a}$) thereof to either decrease or increase so as to equal the discharge set point temperature. After reaching the desired set point temperature, the actual combustion temperature is checked by the computer to determine if the temperature $T_{2a}$ is within the stability limits of the catalyst. If so, the computer then checks the combustor to determine if the combustor is operating substantially at stoichiometry. If the temperature $T_{2a}$ requires correction, then an adjustment is made in the mass ratio of the water to fuel in the fuel-mixture. As the response time for making this type of correction may be fairly long, information as to prior similar corrections is stored in the computer data bank and is taken into consideration in making subsequent changes in the fuel-mixture mass ratios so as to avoid over compensation in making changes in the mixing of water and fuel to produce the emulsified fuel-mixture. Assuming that some form of correction is needed, the percentage of water in the fuel-mixture is either increased or decreased as may be appropriate to either decrease or increase the actual combustion temperature $T_{2a}$ to bring this temperature within the stability limits of the combustion system.

Advantageously, in making a change in the amount of fuel in the fuel-mixture, an equal but opposite change is made in the amount of injection water so that the total quantity of water passing through the combustor 11 remains the same (sub-steps K–N). As a result, the outlet fluid temperature $T_{3a}$ remains the same while allowing for adjustment in the combustion temperature to arrive at a temperature and space velocity of fluids passing over the catalyst 12 at which combustion occurs most efficiently for the amount of fuel being combusted.

For example, if the actual combustion temperature $T_{2a}$ is found to be too low, and any previously corrected fuel-mixture has had time to reach the combustor, then by decreasing the amount of water in the fuel-mixture and making a corresponding increase in the amount of water in the injection water, the temperature $T_{2a}$ should increase without any corresponding change in the temperature $T_{3a}$ of the fluids exhausted from the combustor. If the combustion temperature $T_{2a}$ where too high, the reverse follows with the combustion temperafure $T_{2a}$ being lowered by increasing the quantity of water in the fuel-mixture and decreasing the amount of injection water by a like quantity.

Figure 11A:
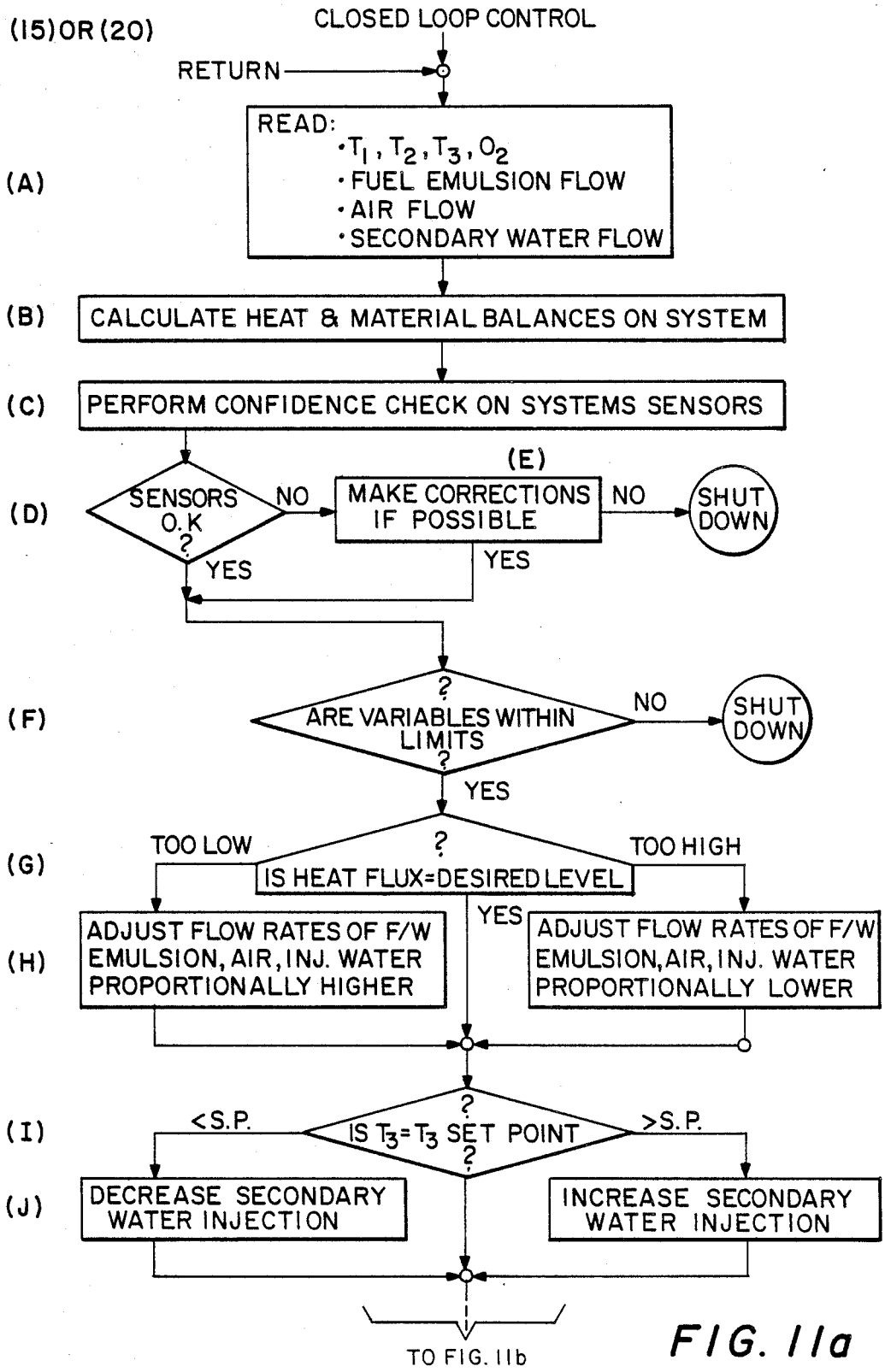
Figure 11B:
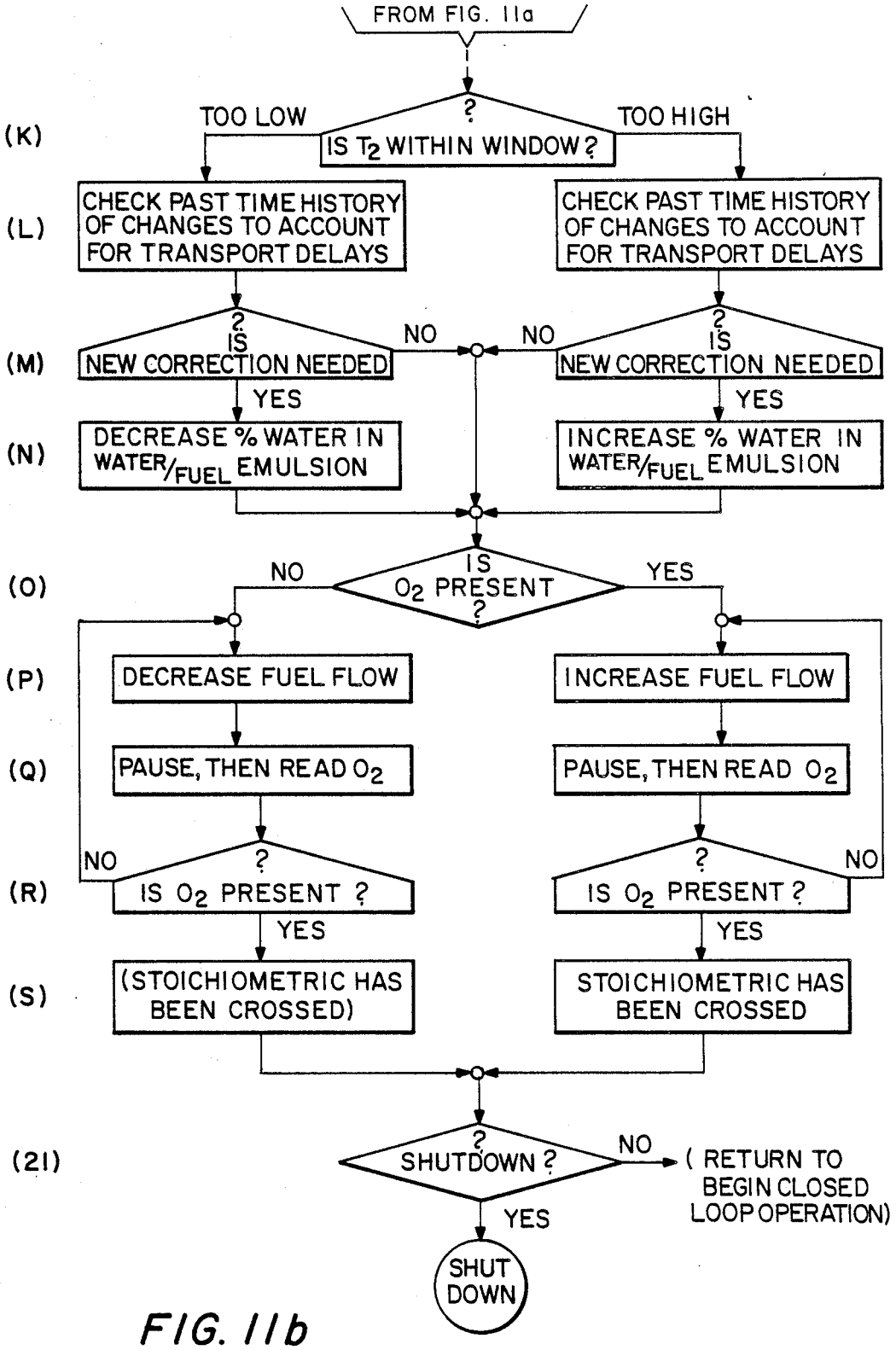

To assure combustion in stoichiometric quantities, the oxygen sensor OS is utilized to detect the oxygen content (presence or absence) of oxygen in the heated fluids in the discharge chamber 25 of the combustor 11. If oxygen is present in these heated fluids, the fuel-mixture is being combusted lean and coversely, if no oxygen is present, the fuel-mixture is being combusted either stoichiometrically or as a rich mixture. To obtain stoichiometric combustion herein, the amount of fuel is increased or decreased relative to the amount of oxygen being supplied to the combustor until the change in the amount of fuel is negligible in changing from an indication of oxygen presence to an indication that oxygen is not present in the heated discharge fluid of the combustor. Thus, for example in FIG. 11*b* substeps O–S of step 20, if oxygen is determined to be present, the fuel flow is increased relative to the oxygen flow to provide additional fuel in a small incremental amount for combusting with the amount of air being supplied to the combustor. After a suitable period of time has passed allowing the combustor to respond to the change in the burn-mixture, data from the oxygen sensors is again considered by the computer to determine whether oxygen is present or absent. If oxygen is present, this sub-cycle repeats to again increase the fuel suppled to the combustor. However, if no oxygen is detected as being present, then stoichiometry has been crossed and the burn-mixture will be being supplied to the combustor in substantially stoichiometric quantities. If oxygen is found to be present in the first instance, the fuel supply is decreased incrementally relative to the oxygen supply in a similar manner until stoichiometry is crossed. While the foregoing description establishing stoichiometric dcombustion by controlling the relative amounts of fuel and oxygen, this may be accomplished either by adjusting the flow of fuel relative to a fixed amount air as shown in FIG. 11*b* or by adjusting the flow of air relative to a fixed amount of fuel.

Once the combustor 11 is burning stiochiometrically, the control process recycles continuously computing through the closed loop control cycle (step 20) to maintain stoichiometric combustion at the desired heat release rate and output temperature $T_{3sp}$ until the steam flooding operation is completed. At the end of each cycle, if the operation has not received a shut-down signal (step 21) the loop repeats, otherwise, the system is shut down.

As an alternative method of establishing stoichiometric combustion of the fuel-mixture without the use of an oxygen sensor, the actual combustion temperature $T_{2a}$ for a particular fuel may be used as a secondary indication of stoichiometric combustion. In this connection, the information disclosed in FIG. 13 and previously described herein is utilized to vary the flow volume of the emulsion relative to the volume of air in order to obtain stoichiometric quantities of air and fuel for combustion in the combustor 11. In considering the graph of FIG. 13, it will be appreciated that in attempting to reach the peak temperature of a curve it is necessary to know whether combustion is taking place with a burn-mixture which is either rich or lean. If the burn-mixture is rich, the proportional flow of emulsion should be decreased relative to the flow of air in order to increase the combustion temperature to a peak temperature. But if the combustion mixture is lean, it is necessary to increase the proportion of emulsion relative to air in order to increase the combustion temperature to a peak temperature. Accordingly, the first determination made is whether the temperature $T_{2a}$ for the existing emulsion has increased or decreased over the temperature previously read into the computer data base in response to a change in the emulsion flow rate. If the temperature $T_{2a}$ has increased, then the flow of emulsion should be increased again if the flow of emulsion was increased previously. This would occur when burning lean. If the temperature has increased in response to relative decrease in the flow volume of the emulsion to air, then the flow volume of emulsion should be decreased again and this would occur when burning rich. If, on the other hand, the temperature $T_{2a}$ has decreased and the flow of emulsion was also decreased previously, the flow of emulsion should be adjusted upwardly because this set of conditions would indicate lean burning. Alternatively, if the temperature has decreased and the flow of emulsion was increased previously, the flow of emulsion should be decreased because this set of conditions would indicate rich burning. Continued checking of the temperature and the making of corresponding subsequent adjustments in the relative flow of emulsion to air are made in finer and finer increments to obtain stoichiometric flow rates of the air and emulsion for a particular fuel.

Advantageously, with the combustor system as described thus far, it will be appreciated that as formation conditions change, the combustor operation can be adjusted automatically within limits to provide the desired heat release rate to the formation at the desired temperature $T_3$ while still combusting efficiently. For example, assuming that as the steam flooding proceeds over a period of time the injectivity of the formation increases, then the working fluid produced by the combustor will flow into the formation more easily and because of this, flow past the catalyst 12 will increase thereby tending to increase the heat release rate into the formation. With the exemplary combustor however, adjustment may be made in the heat realease rate by reducing the relative flow of fuel-mixture as in sub-steps G and H. This may be done to certain degree for any particular mass ratio of water to fuel because of the width of the combustion envelope for the combustor using this particular fuel-mixture (see FIGS. 15–17). If, however, the injectivity decrease is substantial, a change also may be required in the mass ratio of the fuel-mixture in order to combust within the operable space velocities for the combustor at the new injectivity pressure requirements. In this instance, a lower mass ratio of water to fuel in the fuel-mixture would be expected in order to maintain substantially the same heat release rate into to formation at a lower pressure and, as a result, a greater relative amount of injection water may be needed in order to maintain the exhaust temperature $T_{3a}$ at the desired set point temperature $T_{3sp}$.

In accordance with the more detailed aspect of the present invention, a novel procedure is followed in starting the combustor 11 to bring the catalyst 12 up to a temperture at which catalytic combustion of the burn-mixture may take place. For this purpose, while applying electrical energy to heat the nichrome heating element 58, a thermally combustible start fuel is supplied to the inlet chamber 24 of the combustor and is ignited to bring the catalyst temperature up to its light-off temperature. Herein, the start fuel is a graded fuel including a first portion which has a low auto ignition temperature (steps 14 through 18) followed by an intermediate portion (step 19) having a higher combustion temperature and finally by the burn-mixture (steps 19 and 20) to be combusted normally in the combustor.

Specifically methanol is contemplated as comprising the first portion of the start fuel. Methanol has an auto-ignition temperature of 878° F. Other suitable low auto-ignition temperature fuels that may be used in the first portion of the start fuel include diethyl ether which has an auto-igniting temperature of 366° F.; normal octane, auto-ignition temperature of 464° F.; 1-tetradecene, auto-ignition temperature of 463° F.; 2-methyl-octane auto-ignition temperature of 440° ; or 2-methyl-nonane which has an auto-ignition temperature of 418° F. The intermediate portion of the start fuel is contemplated as being a diesel fuel or other heavy hydrocarbon liquid and a mixture of the start fuel and the fuel-mixture to be combusted. During start up, the first portion of the graded start up fuel may be burnt thermally to both heat the catalyst 12 and to provide some recirculating heat for preheating the subsequent fuel. As the outlet temperature $T_2$ of the catalyst reaches the lower limit of the combustion range for the catalyst, the light-off temperature of the catalyst will be surpassed and the burn-mixture may be phased into the combustor for normal steady state combustion.

As shown in FIG. 1, a start fuel pump 91 is connected by a branch line 93 to the inlet line 19 of the combuster 11 to deliver the start fuel to the combustor upon start up. A valve 94 in the branch line is selectively closed and opened to regulate the flow of start fuel into the branch line as may be desired during the start up and shut down of the system. Preferably, operation of the heating element 58 is controlled through the computer 27 so as to be lit during start up as long as the temperature, $T_1$, in the inlet chamber 24, is below the auto-ignition temperature of methanol.

Figure 5:
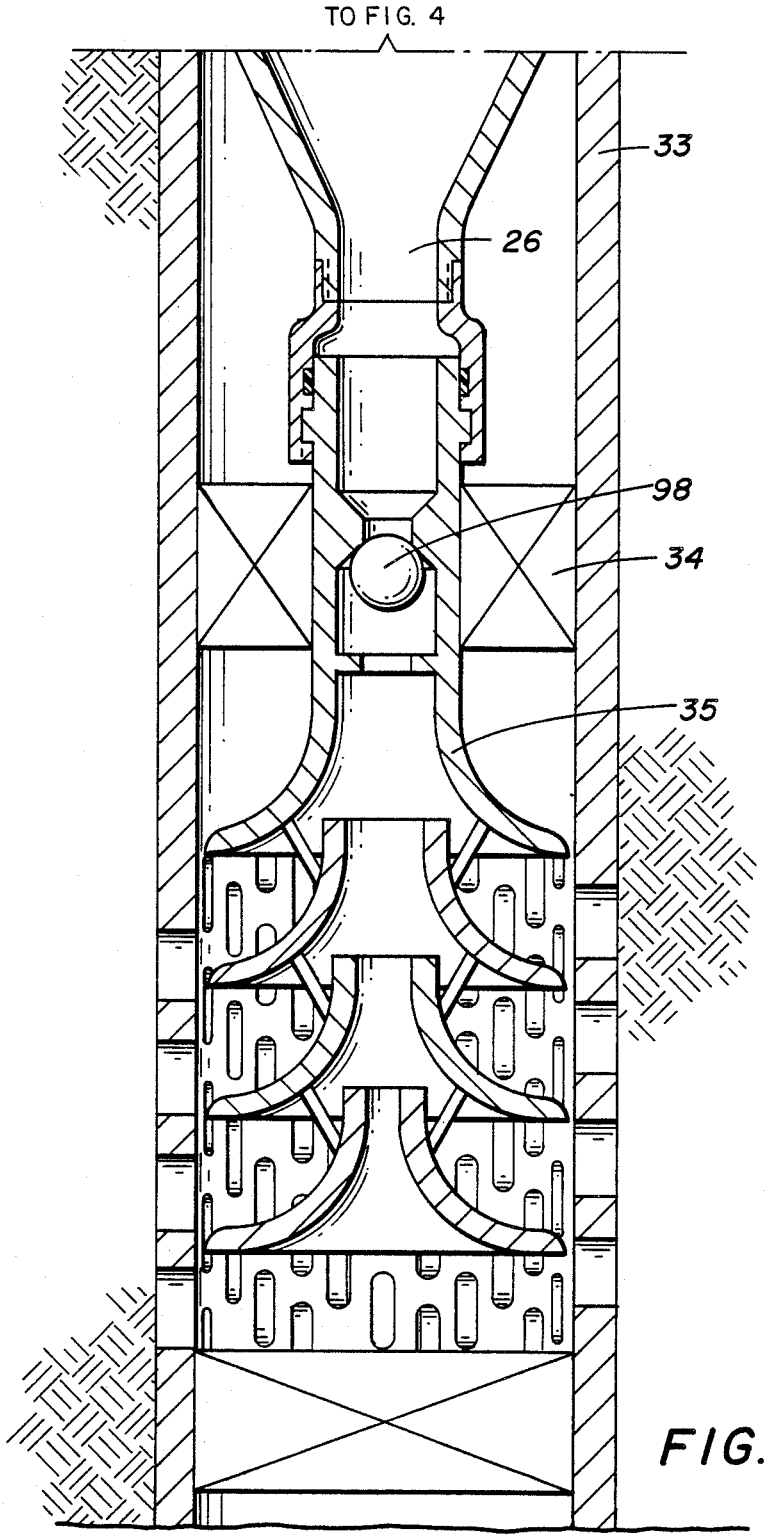
Figure 10:
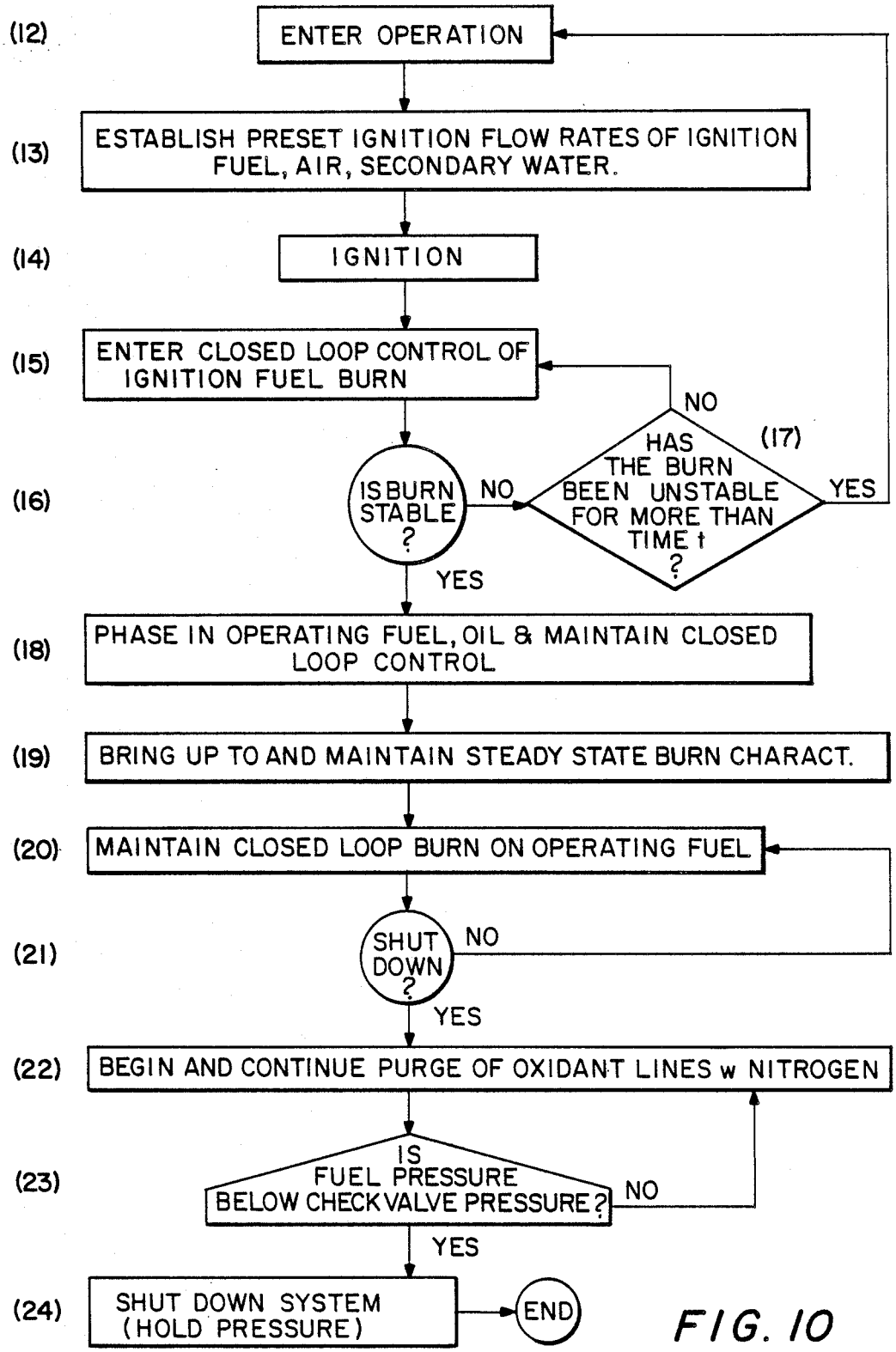

In shutting down the exemplary combustion system 10, a special sequence of steps is followed to protect the catalyst 12 against thermal shock and to keep it dry for restarting (see FIG. 10 steps 22 through 24). Accordingly, when shutting down the system the flow volumes of fuel and air are maintained in stoichiometric quantities while a higher concentration of water to fuel is fed into the emulsion ultimately reducing the temperature $T_1$ in the inlet chamber 24 to approximately the light-off temperature for the catalyst. Upon reaching this light-off temperature, the flow of emulsion is reduced along with a proportional reduction in air so as to maintain stoichiometry. As the air is reduced in volume, a like volume of nitrogen from a source 96 is introduced into the line 20 through a valve 92 until the pressure in the fuel mixture line 19 drops below the check valve pressure causing the check valve 66 to close. At this point nitrogen is substituted completely for the air and pressure in the line 20 is maintained so as to drive all of the burn-mixture in the inlet chamber 24 past the catalyst 12. As the burn-mixture is expelled, the outlet temperature of the catalyst $T_2$ will begin to drop and, as it drops, the amount of injection water is reduced proportionally. Ultimately, the injection water is shut-off when $T_2$ equals the desired combustor discharge temperature $T_{3sp}$. Preferably, in the downhole version, pressure downstream of the combustor is maintained by a check valve 98 (see FIG. 5) above the nozzle 32 so as to pervent well fluids from entering the combustor 11 after shutdown.

Advantageously, for restarting purposes, a start plug of diethyl ether or methanol may be injected into the fuel line 19 at an appropriate stage in the shut down procedure so that a portion of this start plug passes the check valve 66 at the inlet to the combustor 11. If this latter step is followed, the inlet temperature $T_1$ may increase suddenly as a portion of the start plug enters the inlet chamber 24. By stopping flow of the fluid in the fuel line 19 with this sudden increase in temperature, the catalyst may be easily restarted with the portion of the plug remaining above the check valve.

In view of the foregoing, it will be appreciated that the present invention brings to the art a new and particularly useful combustion system 10 including a novel combustor 11 adapted for operation in a unique fashion to produce a heated working fluid. Advantageously, the working fluid may be produced to efficiently over a wide range of heat release rates, temperatures, and pressures so that the same combustor may be used for a wide range of applications such as in the steam flooding of oil bearing formations having widely different reservoir characteristics. To these ends, boilerless production of the working fluid is achieved by construction of the combustor with the catalyst 12 being used as the primary combustor. Advantageously, in using this combustor the diluent is mixed in a controlled amount intimately with the fuel prior to combustion and thus serves to keep the combustor temperature at a selectively regulated low temperature for efficient combustion. An additional selected quantity of diluent is injected into the heated fluid exiting the catalyst to cool the fluid to its useful temperature. From one use to the next or as changes in output requirements develop, the flow of diluent, fuel and air may be regulated so as to produce the characteristics desired in the discharge fluid of the combustor.

The embodiments of the invention in which an exclusive property or privilege is claimed are defined as follows:

1. A combustor including means for catalytically combusting a fuel admixture of a non-combustible diluent and a carbonaceous fuel intimately mixed in a thermally self-extinguishing mass ratio so such combustion directly heats said diluent to produce a heated fluid, means for providing relative quantities of said carbonaceous fuel and an oxidant for such combustion, said means for catalytically combusting comprising a housing with an inlet chamber toward one end thereof and a discharge chamber toward the other end thereof, a catalyst supported within said housing between said chambers, means for mixing said admixture and said oxidant in said inlet chamber to form an inlet mixture preparatory to flow through said catalyst, a post-combustion injector for spraying a non-combustible cooling fluid with a high heat capacity into said heated fluid for cooling purpose, a cooling fluid control, a temperature sensor for said heated fluid for detecting the temperature thereof prior to injection of said cooling fluid, control means connected between said sensor and said flow control for transmitting a control signal to said control-fluid flow control to cause said flow control to adjust the flow of said cooling fluid into said discharge chamber for lowering the temperature of said working fluid to a selected temperature, and a post-injection temperature sensor for detecting the temperature of said heated fluid after injection of said cooling fluid, said control means being connected with said latter sensor and including a computer for comparing said post-injection temperature to said selected temperature and transmitting an appropriate signal to said cooling fluid flow control to adjust the flow of said cooling fluid to cool said working fluid to said selected temperature.

2. A combustor as defined by claim 1 including a conduit extending from said discharge chamber through said housing and to a source of cooling fluid.

3. A catalytic combustor including a housing with an inlet chamber toward one end thereof and a discharge chamber toward the other end thereof, a catalyst supported within said housing between said chambers for combusting a fuel emulsion of a non-combustible diluent and a carbonaceous fuel mixed in a thermally self-extinguishing mass ratio so such combustion directly heats said diluent to produce a heated working fluid, means for providing substantially stoichiometric quantities of said carbonaceous fuel and an oxidant for such combustion, means for mixing said fuel emulsion and said oxidant in said inlet chamber to form a burn-mixture to pass over said catalyst for combustion, and means for preheating said burn-mixture and said means for preheating being contained within said housing, said means for providing stoichiometric quantities of said carbonaceous fuel and an oxidant including an emulsion flow control, an oxidant flow control, sensor means for said working fluid, computer means connected between said sensor means and said flow controls for receiving from said sensor means a signal representative of a sensed characteristic of said working fluid and sending at least one control signal to at least one of said controls in response thereto to vary the relative mass flow between said fuel in said emulsion and said oxidant toward substantially stoichiometric quantities.

4. A catalytic combustor as defined by claim 3 wherein said sensor means comprises an oxygen sensor and said sensed characteristic of said working fluid is oxygen content.

5. A catalytic combustor as defined by claim 3 including a post-combustion injector for spraying a non-combustible cooling fluid having a high heat capacity into said working fluid to cool the latter, a cooling fluid flow control, a post-injection temperature sensor for detecting the temperature of said working fluid after injection of said cooling fluid, a comparator in said computer means for comparing said post-injection temperature to a selected temperature and for transmitting an appropriate signal to said cooling fluid flow control for said latter control to adjust the flow of said cooling fluid to cool said working fluid to said selected temperature.

6. A system for enhancing oil recovery from an oil bearing formation comprising means for producing a combustion-heated working fluid, including a mixture comprised of a non-combustible diluent and carbonaceous fuel mixed in a thermally self-extinguishing mass ratio, a source of said mixture, a catalytic combustor for combusting said fuel to thereby directly heat said diluent to produce said working fluid, said combustor being located above the surface of the oil bearing formation, means for delivering said mixture from said source to said combustor, an air compressor connected to said combustor for delivering air thereto, and means for controlling the relative mass flow of said fuel in said mixture and said air to substantially stoichiometric quantities for combustion in said combustor, said source of said mixture including a source of diluent, a source of carbonaceous fuel, an emulsifier communicating with both said diluent and carbonaceous fuel sources for mixing said diluent and said fuel together in said mass ratio, pump means for delivering relative quantities of said diluent and said fuel to said emulsifier in proportion to said mass ratio, means for injecting said working fluid into a downhole formed in the oil bearing formation to lessen the viscosity of the oil therein and thereby aid recovery of such oil from the formation, means for sealing said working fluid within the downhole, and means for placing said air in heat exchange relationship with that portion of the working fluid contained within said downhole.

7. A system as defined by claim 6 including a static mixer located between said emulsifier and said diluent and carbonaceous fuel sources for mixing said proportional quantities of said diluent and said fuel prior to emulsification.

8. A system as defined by claim 7 including a deionizer upstream of said mixer.

9. A system as defined by claim 8 including a branch line downstream of said deionizer and upstream of said mixer and communicating between said water source and said combustor for injecting deionized water into said working fluid to cool such working fluid and means for adjustment of the mass flow of said injection water for regulating the temperature of said cooled working fluid.

10. A system as defined by claim 6, wherein said means for controlling the relative mass flow of said fuel and said air includes flow control means for at least one of said air and said mixture, an oxygen sensor for said working fluid, and a computer connected between said oxygen sensor and said flow control means for transmitting a control signal thereto in response to the oxygen content detected by said sensor for said flow control means to vary the relative mass flow between said mixture and said air to obtain a specified oxygen content in said working fluid.

11. A system as defined by claim 6 including a start-fuel source and a start-fuel controller means for delivering a quantity of start-fuel from said source to said combustor for combustion to bring said catalyst into an operative condition for catalytic combustion of said mixture upon termination of delivery of said start-fuel.

12. A steam generating system comprising a catalytic combustor for producing steam including a housing with an inlet chamber for receiving a water-fuel mixture and oxidant and a discharge chamber from which products of combustion and steam exit the housing, a catalyst supported within said housing between said chambers for combusting the water-fuel mixture with a quantity of oxidant to produce the steam, a source of said water-fuel mixture mixed in a thermally self-extinguishing mass ratio communicating with said inlet chamber, means for delivering said mixture from said source to said inlet chamber, a source of oxidant communicating with said inlet chamber for mixing with said mixture, means for causing a quantity of said oxidant to flow into said inlet chamber, and means for controlling the relative mass flow of said mixture and said oxidant for combustion in the presence of said catalyst, said source of said mixture including a source of water, a source of carbonaceous fuel, an emulsifier for mixing said water and said fuel communicating with both said water and fuel sources, and flow control means for delivering relative quantities of said water and said fuel to said emulsifier in proportion to said mass ratio, a water injector in said discharge chamber and communicating with said water source for injecting water into the steam flowing from the catalyst to produce additional steam, and means for adjustment of the mass flow of such injected water for regulating the temperature of the total steam output of said combustor.

13. A steam generating system as defined by claim 12 including a deionizer communicating with said water source for deionizing the water before delivery to said emulsifier.

14. A steam generating system as defined by claim 12 including a static mixer located between said emulsifier and said water and said fuel sources for mixing said water and fuel in proportion to said mass ratio prior to emulsification.

15. A steam generating system as defined by claim 12 wherein said water and said fuel are mixed in a mass ratio greater than 0.2.

16. A steam generating system as defined by claim 12 wherein said injected water mass flow adjustment means includes an injection water flow control, a temperature sensor in said discharge chamber for detecting the temperature of said steam prior to such water injection, a computer connected between said sensor and said injection water flow control for transmitting a control signal to the latter in response to the temperature detected by said sensor to cause said injection water flow control to adjust the rate of mass flow of injection water into said discharge chamber as needed to obtain a selected output steam temperature.

17. A steam generating system as defined by claim 16 including a post-injection temperature sensor for detecting the actual temperature of said output steam, said computer being connected with said latter sensor for comparing said actual output steam temperature to said selected output steam temperature and transmitting an appropriate signal to said water flow control to adjust said flow for said injection water to said steam flowing from said catalyst to said selected temperature.

18. A steam generating system as defined by claim 12 including a start-fuel source and a start-fuel controller means for delivering a quantity of start-fuel from said source to said combustor for combustion therein.

19. A steam generating system as defined by claim 18 wherein said start-fuel is a combustible fuel which is thermally self-sustaining and which may be ignited at a relatively low temperature, igniter means disposed in said combustor for igniting said start fuel, an inlet temperature sensor also disposed in said inlet chamber, and a computer connected between said start-fuel controller and said inlet temperature sensor and responsive to the temperature detected by said inlet temperature sensor to transmit a signal to said start-fuel controller to terminate the flow of start-fuel to said combustor upon reaching reaction temperatures for said catalyst.

20. A steam generating system as defined by claim 19 wherein said igniter means comprises an electrical heating element within said combustor for bringing said catalyst to its light-off temperature.

21. A steam generating system as defined by claim 19 wherein said igniter means comprises an electrical element disposed in said inlet chamber for igniting said start fuel.

22. A steam generating system as defined by claim 12, wherein said means for controlling the relative mass flow of said mixture and said oxidant includes flow controller means for at least one of said mixture and said oxidant, sensor means in said discharge chamber for detecting a characteristic of said steam, and a computer connected between said sensor means and said flow controller means for transmitting a control signal thereto in response to the characteristic detected by said sensor for said flow controller means to vary the relative mass flow between said mixture and said oxidant to obtain steam having a specified characteristic resulting from combustion in said catalyst

23. A steam generating system as defined by claim 22 including a mass ratio control for setting the mass ratio of said water relative to said fuel, said sensor means including a temperture sensor for detecting the actual temperature of said steam, said computer further comparing said actual temperature to a predesignated maximum temperature and sending another control signal to said mass ratio control in response thereto to change said mass ratio as needed for keeping said actual temperature less than said predesignated maximum temperature.

24. A steam generator as defined by claim 23 wherein said computer further compares said actual temperature to a predesignated minimum temperature and sends still another control signal to said mass ratio control as determined by this latter comparison to keep said actual temperature no less than said predesignated minimum temperature.

25. A steam generating system as defined by claim 22 including a mass ratio control for setting the mass ratio of said water relative to said fuel, said computer for comparing said actual temperature to a predesignated minimum temperature and sending another control signal to said mass ratio control in response thereto to change said mass ratio as needed for keeping said actual temperature no less than said predesignated minimum temperature.

26. A steam generating system as defined by claim 22 wherein said means for controlling the relative mass flow of said mixture and said oxidant includes an oxidant flow control, said sensor means including an oxygen sensor in said discharge chamber for detecting the oxygen content of said steam, in said computer receiving from said oxygen sensor a signal representative of the oxygen content of said steam as detected by said oxygen sensor and sending a control signal to said oxidant flow control in response thereto to vary the flow of said oxidant to obtain a specified oxygen content in said steam.

27. A steam generating system as defined by claim 22 wherein said means for controlling the relative mass flow of said mixture and said oxidant includes a mixture flow control, said sensor means including an oxygen sensor in said discharge chamber for detecting the oxygen content of said steam, said computer sending a control signal to said mixture flow control in response thereto the oxygen content sensed by said sensor to vary the flow of said mixture to obtain a specified oxygen content in said steam.

28. A steam generating system as defined by claim 22 wherein said means for controlling the relative mass flow of said fuel and said oxidant includes mixture flow control, an oxidant flow control, said sensor means including an oxygen sensor in said discharge chamber for detecting the oxygen content of said steam, and in said computer sending at least one control signal to at least one of said flow controls in response the oxygen content detected by said sensor to vary the relative mass flow between said mixture and said oxidant to obtain steam having a specified oxygen content.

29. A steam generating system as defined by claim 28 wherein said combustor includes means for preheating at least one of said mixture and said oxidant.

30. A steam generating system as defined by claim 29 wherein said means for preheating includes a device supported within said housing for conducting a portion of the heat of combustion of said fuel in said catalyust to at least one of said mixture and said oxidant.

31. A steam generating system as defined by claim 30 wherein said device includes a heat conducting passage connected between said discharge chamber and said inlet chamber for a portion of the products of combustion to flow from said discharge chamber into said inlet chamber for preheating in said inlet chamber.

32. A steam generating system as defined by claim 29 wherein said combustor includes a post-combustion injector for spraying water into the steam from said catalyst for cooling purposes, an injection water flow control, said sensor means including a temperature sensor in said discharge chamber for detecting the temperature of said steam prior to injection of said water, said computer being connected between said temperature sensor and said injection water flow control for transmitting a control signal thereto to cause said latter flow control to adjust the flow of said water into said discharge chamber for lowering the temperature of said steam from said catalyst to a selected temperature.

33. A steam generator as defined by claim 32 including a post-injection temperature sensor for detecting the temperature of said steam after injection of said cooling water, said computer being connected to said latter sensor and comparing said post-injection temperature to said selected temperature and transmitting an appropriate signal to said injection water flow control to adjust the flow thereof to cool said steam to said selected temperature.

34. A steam generating system as defined by claim 12 wherein said means for controlling relative mass flow of said mixture and said oxidant includes a mixture flow control, sensor means for detecting a characteristic of the heated fluid including the steam produced by combustion of said mixture, control means connected between said sensor means and said mixture flow control for receiving a characterizing signal from said sensor means and sending a control signal to said mixture flow control in response thereto to vary the flow of said mixture.

35. A combustor as defined by claim 34 wherein said mixture flow control includes a mass ratio control for setting the mass ratio of said water relative to said carbonaceous fuel, said sensor means including a temperature sensor for said heated fluid, said control means being connected with said temperature sensor and providing for comparing the fluid temperature detected by said temperature sensor to a predesignated maximum temperature and sending another control signal to said mass ratio control as determined by said last mentioned comparison to increase said mass ratio for keeping said fluid temperature less than said predesignated maximum temperature.

36. A combustor as defined by claim 35 wherein said control means further provides for comparing said fluid temperature to a predesignated minimum temperature and sending still another control signal to said mass ratio control as determined by this latter comparison to decrease said mass ratio for keeping said fluid temperature no less than said predesignated minimum temperature.

37. A combustor as defined by claim 36 wherein said mass ratio control includes a water flow control and a fuel flow control, said latter controls being connected to said control means for receiving a control signal therefrom for setting the mass ratio of said water relative to said fuel.

38. A steam generating system comprising a catalytic combustor for producing steam including a housing with an inlet chamber for receiving a water-fuel emulsion and air, and a discharge chamber from which products of combustion and steam exit the housing, a catalyst supported within said housing between said chambers for combusting the emulsion with a stoichiometric quantity of air to directly produce the steam; a water source; a carbonaceous fuel source; an emulsifier communicating with both of said sources to produce said emulsion; flow control means for delivering relative quantities of said water and said fuel from said sources to said emulsifier in proportions to produce said emulsion with a thermally self-extinguishing mass ratio of water to fuel; means for delivering said emulsion from said emulsifier to said inlet chamber; a deionizer communicating with said water source for deionizing the water before delivery thereof to said inlet chamber; a mixer located upstream of said emulsifier and communicating with said water and fuel sources for mixing said water and said fuel in said mass ratio proportions prior to emulsification thereof; an air compressor communicating with said inlet chamber for delivering air to mix therein with said emulsion; and means for controlling the relative mass flow of said emulsion and said air for stoichiometric combustion in said catalyst including a sensor means for detecting stoichiometric burning, a flow controller for at least one of said emulsion and said air, and a computer connected between said sensor means and said flow controller for transmitting a signal thereto in response to the nature of the combustion sensed for said flow controller to vary the relative mass flow of said emulsion and air to obtain substantially stoichiometric quantities thereof; said combustor including a post-combustion injector for spraying water into the steam from said catalyst for cooling purposes, an injection water flow control, a temperature sensor in said sensor means for detecting the temperature of said steam prior to injection of said water, said computer being connected between said sensor and said injection water flow control for transmitting a control signal thereto to cause said latter control to adjust the flow of said water into said discharge chamber for lowering the temperature of said steam from said catalyst to a selected temperature.

39. A steam generating system as defined by claim 38 wherein said sensor means includes a temperature sensor for detecting the actual temperature of the steam produced by stoichiometric combustion in said catalyst, and said system further includes a mass ratio control for setting the mass ratio of said water relative to said fuel, said computer further comparing said actual temperature to a predesignated maximum temperature and sending another control signal to said mass ratio control to change said mass ratio as needed for keeping said actual temperature less than said predesignated maximum temperature, said computer also comparing said peak temperature to a predesignated minimum temperature and sending still another control signal to said mass ratio control as determined by this latter comparison to keep said actual temperature no less than said predesignated minimum temperature.

40. A steam generating system as defined by claims 38 or 39 including a preheat device supported within said housing for conducting a portion of the heat of combustion of said emulsion in said catalyst to at least one of said emulsion and said air to preheat the latter.

41. A steam generating system as defined by claim 38 including a start-fuel source and a start-fuel controller means for delivering a quantity of start-fuel from said source to said combustor for combustion therein to bring said catalyst to a reaction temperature and condition for catalytic combustion of said emulsion upon termination of delivery of said start fuel.

42. A steam generating system as defined by claim 41 wherein said start fuel is a combustible fuel which is thermally self-sustaining and which may be ignited at a relatively low temperature, an igniter disposed in said inlet chamber for igniting said start fuel, an inlet temperature sensor also disposed in said inlet chamber, and said computer also being connected between said start-fuel controller and said inlet temperature sensor and responsive to the temperature detected by said inlet temperature sensor to transmit a signal to said start-fuel controller to terminate the flow of start-fuel to said combustor upon reaching reaction temperatures for said catalyst.

43. A steam generator as defined by claim 38 including a post-injection temperature sensor for detecting the temperature of said steam after injection of said cooling water, said computer being connected to said latter sensor and comparing said post-injection temperature to said selected temperature and transmitting an appropriate signal to said injection water flow control to adjust the flow thereof to cool said steam to said selected temperature.

44. A process for producing a heated working fluid by combusting a carbonaceous fuel in a combustor comprising the steps of:

(a) mixing the carbonaceous fuel with a non-combustible diluent to form a fuel-mixture which has a ratio of diluent to fuel that is thermally self-extinguishing, (b) providing a substantially stoichiometric quantity of oxidant to the fuel-mixture for substantially stoichiometric combustion, (c) catalytically combusting said fuel-mixture and oxidant to directly heat the diluent in the mixture to produce a heated working fluid comprised of the heated diluent and the products of such combustion, wherein said diluent is water, said oxidant is air, and said working fluid includes steam, (d) controlling the mass ratio of said burn-mixture relative to the mass of said oxidant by flowing said masses over said catalyst and, (1) sensing a characteristic of said working fluid representative of stoichiometric combustion of said fuel-mixture, and (2) varying the flow rate of said fuel-mixture relative to the flow rate of said oxidant in accordance with said sensed characteristic to change the ratio of relative mass flow to obtain stoichiometric quantities of oxidant and fuel prior to combustion, (e) heating at least one of said mixture and said oxidant prior to combustion by placing a portion of the heated diluent and products of combustion into direct contact with said at least one of said mixture and said oxidant.

45. A process for producing a heated working fluid as defined by claim 44 wherein said steps further include intimately mixing said fuel-mixture with the oxidant prior to combustion.

46. A process for producing a heated working fluid as defined by claim 44 wherein said sensed characteristic is the oxygen content of said heated working fluid.

47. A process for producing a heated working fluid as defined by claim 44 wherein said step (d) further includes:

(d)

(3) sensing the actual temperature of said heated working fluid, (4) comparing said actual temperature to a predesignated maximum temperature and, (5) adjusting the mass ratio of said diluent to said fuel to keep said actual temperature no greater than said predesignated maximum temperature by controlling the relative mass flow of said diluent to the mass flow of said fuel.

48. A process for producing a heated working fluid as defined by claim 47 wherein said step (d) further includes:

(d)

(6) comparing said actual temperature to a predesignated minimum temperature and, (7) adjusting the mass ratio of said diluent to said fuel to keep said actual temperature no less than said predesignated minimum temperature by controlling the relative mass flow of said diluent to the mass flow of said fuel.

49. A process for producing a heated working fluid as defined by claim 44 wherein step (e) further includes, providing a direct contact heat exchange between said combustion heat and one of said mixture and said oxidant for said preheating.

50. A process for producing a heated working fluid as defined in claim 49 wherein step (e) further includes using radiant heat from combustion in said catalyst for preheating.

51. A process for producing a heated working fluid as defined by claim 49 wherein said steps further include, sensing the temperature of said mixture and said oxidant before combustion and after said heating prior to combustion.

52. A process for producing a heated working fluid by combusting a carbonaceous fuel in a combustor comprising the steps of:

(a) mixing the carbonaceous fuel with a non-combustible diluent to form a fuel-mixture which has a mass ratio of diluent to fuel that is thermally self-extinguishing, (b) providing a substantially stoichiometric quantity of oxidant to the fuel-mixture for substantially stoichiometric combustion, (c) catalytically combusting said fuel-mixture and oxidant to directly heat the diluent in the mixture to produce a heated working fluid comprised of the heated diluent and the products of such combustion, and (d) controlling the mass ratio of said burn-mixture relative to the mass of said oxidant by flowing said masses over said catalyst and, (1) sensing a characteristic of said working fluid representative of stoichiometric combustion of said fuel-mixture, and (2) varying the flow rate of said fuel-mixture relative to the flow rate of said oxidant in accordance with said sensed characteristic to change the ratio of relative mass flow to obtain stoichiometric quantities of oxidant and fuel prior to combustion, (e) preheating at least one of said mixture and said oxidant prior to combustion, and using a portion of heat from combustion of said fuel for preheating, and (f) injecting a non-combustible cooling diluent with a high heat capacity into said heated working fluid in an amount dependent upon the sensed temperature of said working fluid prior to such injection which is sufficient to lower said heated working fluid temperature including said cooling fluid to a selected temperature.

53. A process for producing a heated working fluid as defined by claim 52 wherein said steps further include:

(g) sensing the temperature of said working fluid after injection, (h) comparing such post injection temperature to said selected temperature, and (i) adjusting the flow of said injection diluent into said working fluid so said latter sensed temperature is approximately equal to said selected temperature.

54. A process for producing steam by combusting a carbonaceous fuel in a combustor comprising the steps of:

(a) mixing the carbonaceous fuel with water to form a fuel-mixture which has a mass ratio of water to fuel that is thermally self-extinguishing, (b) providing a quantity of air to the fuel-mixture for combustion, (c) catalytically combusting said fuel-mixture and air to directly heat the water in the mixture to produce a heated fluid including steam and the heated products of such combustion, (d) maintaining the ratio of the mass flow of said fuel-mixture relative to the mass flow of said air by, (1) sensing the oxygen content of the fluid heated by the combustion, and (2) varying the flow rate of said fuel-mixture relative to the flow rate of said air to change the ratio of relative mass flows thereof to obtain a specified oxygen content in said heated fluid, (e)

(1) sensing the actual temperature of the heated fluid, and (2) comparing said actual temperature to a predesignated maxiumum temperature and, (3) adjusting the mass ratio of said water to said fuel to keep said actual temperature no greater than said predesignated maximum temperature by controlling the relative mass flow of said water to the mass flow of said fuel, (4) comparing said actual temperature to a predesignated minimum temperature and, (5) adjusting the mass ratio of said water to said fuel to keep said actual temperature no less than said predesignated minimum temperature by controlling the relative mass flow of said water to the mass flow of said fuel, (f) providing a direct contact heat exchange between said heated fluid and one of said fluid mixture and said air for preheating, (g) injecting water into said heated fluid in an amount dependent upon said actual temperature of said fluid prior to such injection which is sufficient to lower said actual fluid temperature to a selected temperature, (h) sensing the temperature of said fluid after injection of said water, (i) comparing such post injection temperature to said selected temperature, and (j) adjusting the flow of said injection water into said heated fluid so said latter sensed temperature is approximately equal to said selected temperature.

55. A process for producing steam from combustion of carbonaceous fuel in a combustor comprising the steps of:

(a) mixing the carbonaceous fuel with water to form a fuel-mixture which has a mass ratio of water to fuel that is thermally self-extinguishing, (b) providing a quantity of air to said fluid-mixture for combustion to produce theoretically a heated fluid having at least one characteristic of a given specification, (c) catalytically combusting said fuel-mixture with said air to directly heat the water in the mixture to produce said heated fluid including steam, (d) sensing the actual temperature of such heated fluid, (e) comparing the temperature of such heated fluid to predesignated maximum and minimum temperatures, (f) adjusting the mass ratio of said fuel-mixture to maintain said temperature between said predesignated temperatures and so said characteristic of said heated fluid will approach being at said given specification, (g) sensing said heated fluid for said at least one characteristic, (h) utilizing said characteristic of said heated fluid to determine the extent to which relative flow rates of the water and the fuel in the fuel-mixture need be varied for said adjusting the mass ratio of said mixture to arrive at said given specification for said characteristic, and (i) said characteristic including a peak temperature of combustion for said fuel-mixture.

56. A method of enhanced oil recovery from an oil bearing formation utilizing steam comprising the steps of:

mixing water and carbonaceous fuel together in a thermally self-extinguishing mass ratio, providing substantially a stoichiometric quantity of air for the fuel in such mixture, combusting the fuel with such air in a catalytic combustor so that water in the mixture is directly heated by such combustion, injecting such steam along with the products of such combustion into at least one downhole formed in the formation to lessen the viscosity of the oil therein and thereby aid recovery of such oil from the formation, and placing said air in heat exchange relationship with said steam as the latter is delivered to the formation to preheat said air before entering the combustor.

57. A method of controlling a carbonaceous fuel combustor to produce steam at a desired heat release rate with the aid of a computer, comprising:

providing said computer with a data base for control of combustion in said combustor including, combustion temperature vs. air/fuel-mixture ratio data particular to the carbonaceous fuel in the fuel-mixture to be combusted, information as to a range of acceptable combustion temperatures including a maximum acceptable combustion temperature, $T_{max}$, and a minimum acceptable combustion temperature, $T_{min}$, delivering substantially a preselected quantity of air to the combustor, delivering substantially a theoretical stoichiometric quantity of fuel with said preselected quantity of air to said combustor, delivering a quantity of water with said fuel and air for combustion therein to produce steam by direct combustion heating of said water, constantly determining the actual temperature of said steam, comparing such actual temperature to said maximum and minimum temperatures, $T_{max}$ and $T_{min}$, in said data base through use of said computer, calculating with the computer an adjustment to the existing flow of said water to increase the flow of water if the outlet temperature is not less than $T_{max}$, or to decrease the flow of water if the outlet temperature is not greater than $T_{min}$, and making the appropriate adjustment in the existing flow of the water to combust within said temperature range $T_{min}$, $T_{max}$, constantly adjusting the flow of said fuel-mixture relative to said quantity of air so as to burn the fuel in said mixture substantially stoichiometrically, storing in said data base the outlet temperature for the steam produced with the next previous existing flow of said fuel-mixture, comparing the outlet temperature for the steam produced with the now existing flow of said fuel-mixture to said stored outlet temperature through use of said computer to determine whether said outlet temperature has increased or decreased, storing in said data base the mass flow volume of said fuel-mixture for the next previous flow thereof, comparing the now existing fuel of said fuel-mixture to said stored mass flow through use of said computer to determine whether said flow has increased or decreased, increasing the flow of said fuel-mixture relative to said quantity of air if, said temperature comparison shows said outlet temperature has increased and said flow comparison shows the flow has increased; or said temperature comparison shows said outlet temperature has decreased and said flow was decreased or, decreasing the flow of said fuel-mixture relative said quantity of air if, said temperature comparison shows said temperature has increased, and said flow comparison shows said flow has decreased, or said temperature comparison shows said temperature has decreased and said flow comparison shows said flow was decreased.

58. A combustor operable to stoichiometrically combust selectively variable quantities of a fuel-mixture containing air, carbonaceous fuel and water to produce a heated discharge fluid within a specified range of temperatures, said combustor including;

a housing having an inlet chamber, a discharge chamber and a catalytic zone between said chambers, a catalyst mounted within said catalytic zone for combusting said burn mixture when said mixture is passed thereover at some space velocity within a predetermined range of space velocities, a water injector for directing injection water into said discharge chamber for cooling fluid discharged from said catalytic zone, means for delivering a selectively variable quantity of said carbonaceous fuel to said inlet chamber, means for delivering to said inlet chamber a selectively variable quantity of combustion water relative to said selectively variable quantity of said carbonaceous fuel whereby the catalytic combustion temperature of said burn mixture is not greater than 2300° F., means for delivering a stoichiometric quantity of air to said inlet chamber relative to said quantity of carbonaceous fuel, means for delivering a selectively variable quantity of injection water to said injector for mixing with products of combustion from said catalyst to produce said heated discharge fluid, computer means associated with said fuel combustion water and injection water delivery means and being responsive to input data including base information and sensed information to regulate said means for delivering said fuel, said combustion water, said injection water and said air to selectively vary the heat release rate of said discharge fluid without varying the space velocity of said fuel-mixture through said catalyst outside of said range of space velocities.

59. A method for operating a catalytic combustor containing a catalyst having an upper temperature stability limit to produce a heated discharge fluid at a selectable heat release rate and temperature within specified ranges of heat release rates and discharge temperatures, said method comprising the steps of, delivering substantially stoichiometric quantities of carbonaceous fuel and air to the combustor substantially at said selected heat release rate, delivering a quantity of water to the combustor to absorb heat from combustion of said fuel to maintain theoretically the temperature of said discharge fluid at a selected discharge temperature within said specified range of discharge temperatures, mixing a first portion of said quantity of water with said fuel and said air to form a thermally self-extinguishing burn-mixture having a catalytic adiabatic flame temeprature below the upper temperature stability limit of said catalyst, passing said burn-mixture over the catalyst in the combustor at a selected space velocity within a specified range of space velocities to combust said burn-mixture thereby directly heating the water therein and producing a highly heated fluid exiting the catalyst, injecting a remaining portion of said quantity of water into said highly heated fluid to cool said fluid theoretically to said selected discharge temperature, determining the actual temperature of combustion of said burn-mixture and the actual temperature of said discharge fluid and the actual heat release rate, and adjusting the delivery of said quantities of fuel, air and water to provide said discharge fluid at said selected heat release rate and said selected discharge temperature while maintaining the space velocity within said specified range of space velocities and the actual combustion temperature of said burn-mixture below said upper stability limit.

60. A method of enhanced oil recovery from an oil bearing formation with the aid of a computer to control a catalytic combustor to produce a heated discharge fluid including steam at a desired heat release rate and temperature, comprising:

providing said computer with a data base for control of combustion in said combustor including, desired formation stimulation data including desired heat release rate, temperature data, and oxygen control for the discharge fluid for determined formation characteristics including permeability, pressure and temperature, fuel-mixture data for the fuel-mixtures to be combusted including combustion temperature vs. air/fuel-mixture ratio data particular to the carbonaceous fuel in the fuel-mixture to be combusted, information as to a range of acceptable combustion temperatures including minimum and maximum acceptable combustion temperatures, initially delivering substantially theoretical stoichiometric quantities of air and fuel to said computer at a rate so as to provide said desired heat releast rate, initially delivering a quantity of water to the combustor at a rate so as to absorb heat from combustion of said fuel to theoretically maintain the temperature of said discharge fluid at said desired temeprature, dividing said quantity of water between first and second portions for mixing with said fuel to form said fuel-mixture and injecting into the fluid stream heated by combustion before injection of said heated fluid into the mixing said first portion with said fuel to form a thermally self-extinguishing burn-mixture having a catalytic adiabatic flame temperature below said maximum acceptable combustion temperature, passing said burn-mixture over the catalyst in the combustor at a selected space velocity within a range of space velocities to combust said burn-mixture thereby directly heating the water therein, injecting said second portion of said water into the fluid stream heated by such combustion to cool said stream theoretically to said desired discharge fluid temperature, determining the actual operation data including combustion and discharge fluid temperatures of said fluid stream, the actual flow rates of said first and second portions of water, said air and said fuel-mixture and the oxygen content of said heated fluid stream, providing said computer with said actual operation data, comparing with said computer the actual operation data with said desired heat release rate, said desired discharge temperature, desired combustion temperature range and desired oxygen content, continually determining with said computer adjustments needed in the actual flow rates of said fuel-mixture, said air and said first and second portions of water through said combustor to adjust said actual flow rates to achieve said desired heat release rate, a combustion temperature within said desired combustion temperature range and said desired oxygen content, and adjusting said actual flow rates accordingly.

61. A combustor: comprising, means for catalytically combusting a fuel admixture of a non-combustible diluent and a carbonaceous fuel intimately mixed in a thermally self-extinguishing mass ratio so such combustion directly heats said diluent to produce a heated fluid;

means for providing relative quantities of said carbonaceous fuel and an oxidant for such combustion;

said means for catalytically combusting comprising a housing with an inlet chamber toward one end thereof and a discharge chamber toward the other end thereof, a catalyst supported within said housing between said chambers, means for mixing said admixture and said oxidant in said inlet chamber to form an inlet mixture preparatory to flow through said catalyst;

said combustor further comprising means for preheating said inlet mixture which includes a device supported within said housing for conducting a portion of the heat of combustion of said inlet mixture to said admixture and said oxidant with said device including a heat-conducting passage connected between said discharge chamber and said inlet chamber for a portion of the products of combustion to flow from said discharge chamber into said inlet chamber for direct preheating of said inlet mixture.

62. A combustor as defined by claim 61 wherein said catalyst is a graded-cell catalyst with larger catalytic cells disposed toward the inlet end thereof.

63. A combustor as defined by claim 61 wherein said heat conducting passage includes a plurality of tubes located within said housing and positioned between the interior of said housing and the exterior of said catalyst.

64. A combustor as defined by claim 63 wherein each of said tubes includes a first and a second end portion with said first end portion extending radially inward over the upstream end of said catalyst, said second end portion including a first section which extends radially inward over the downstream end of said catalyst and a second section which extends axially towards the downstream end of said catalyst and includes a divergent open inlet.

65. A combustor: comprising, means for catalytically combusting a fuel admixture of a non-combustible diluent and a carbonaceous fuel intimately mixed in a thermally self-extinguishing mass ratio so such combustion directly heats said diluent to produce a heated fluid;

means for providing relative quantities of said carbonaceous fuel and an oxidant for such combustion;

said means for catalytically combusting comprising a housing with an inlet chamber toward one end thereof and a discharge chamber toward the other end thereof, a catalyst supported within said housing between said chambers, means for mixing said admixture and said oxidant in said inlet chamber to form an inlet mixture preparatory to flow through said catalyst;

a post-combustion injector for spraying a noncombustible cooling fluid with a high heat capacity into said heated fluid for cooling purposes, a cooling fluid flow control, a temperature sensor for said heated fluid for detecting the temperature thereof prior to injection of said cooling fluid, control means connected between said sensor and said flow control for transmitting a control signal to said cooling-fluid flow control to cause said flow control to adjust the flow of said cooling fluid into said discharge chamber for lowering temperature of said working fluid to a selected temperature.

66. A combustor as defined by claim 65 wherein said non-combustible cooling fluid is the same fluid as said diluent and said diluent and said cooling fluid originate from a common source.

67. A catalytic combustor as defined by claim 3 wherein said sensor means comprises a temperature sensor and said sensed characteristic is the temperature of said working fluid, said computer comparing first and second time-spaced working fluid temperatures as detected by said temperature sensor and sending said control signal in response thereto.

68. A downhole steam generator comprising means for catalytically combusting an emulsion comprised of water and carbonaceous fuel mixed in a thermally self-extinguishing mass ratio so catalytic combustion of the fuel directly heats the water to produce steam, means for providing substantially stoichiometric quantities of the fuel and air for such combustion, said means for catalytically combusting including a housing with an inlet chamber toward one end thereof and a discharge chamber toward the other end thereof, and a catalyst supported within said housing between said chambers, said emulsion and air being received within said inlet chamber to form an inlet mixture for combustion in the presence of said catalyst;

said means for providing stoichiometric quantities of said fuel and emulsion including an emulsion flow control, sensor means for said steam, computer means connected between said sensor means and said emulsion flow control for receiving from said sensor means a signal representative of a sensed characteristic of said steam and sending a control signal to said emulsion flow control in response thereto to vary the flow of said emulsion to obtain a substantially stoichiometric amount thereof relative to said air;

said downhole steam generator including a device supported within said housing for conducting a portion of the heat of combustion of said inlet mixture into direct contract with said emulsion and said air.

69. A combustor as defined by claim 68 wherein said device includes a plurality of tubes located within said housing and positioned between the interior of said housing and the exterior of said catalyst.

70. A downhole steam generator comprising means for catalytically combusting an emulsion comprised of water and carbonaceous fuel mixed in a thermally self-extinguishing mass ratio so catalytic combustion of the fuel directly heats the water to produce steam, means for providing substantially stoichiometric quantities of the fuel and air for such combustion, said means for catalytically combusting including a housing with an inlet chamber toward one end thereof and a discharge chamber toward the other end thereof, and a catalyst supported within said housing between said chambers, said emulsion and air being received within said inlet chamber to form an inlet mixture for combustion in the presence of said catalyst;

said means for providing stoichiometric quantities of said fuel and air includes an air flow control, sensor means for said steam, computer means connected between said sensor means and said air flow control for receiving from said sensor means a signal representative of sensed characteristic of said steam and sending a control signal to said air flow control in response thereto to vary the flow of said air to obtain a substantially stoichiometric amount thereof relative to said fuel;

said downhole steam generator further including means for directly heating said emulsion and air which includes a device supported within said housing for conducting a portion of the heat of combustion of said fuel and air to said emulsion and air with said device including a heat conducting passage connected between said discharge chamber and said inlet chamber for a portion of the products of combustion to flow from said discharge chamber into said inlet chamber for preheating said emulsion and air.

71. A combustor as defined by claim 70 wherein said heat conducting passage includes a plurality of tubes located within said housing and positioned between the interior of said housing and the exterior of said catalyst.

72. A combustor as defined by claim 71 wherein each of said tubes includes a first and a second end portion with said first end portion extending radially inward over the upstream end of said catalyst, said second end portion including a first section which extends radially inward over the downstream end of said catalyst and a second section which extends axially towards the downstream end of said catalyst and includes a divergent open inlet.

73. A downhole steam generator comprising means for catalytically combusting an emulsion comprised of water and carbonaceous fuel mixed in a thermally self-extinguishing mass ratio so catalytic combustion of the fuel directly heats the water to produce steam, means for providing substantially stoichiometric quantities of the fuel and air for such combustion, said means for catalytically combusting including a housing with an inlet chamber toward one end thereof and a discharge chamber toward the other end thereof, and a catalyst supported within said housing between said chambers, said emulsion and air being received within said inlet chamber to form an inlet mixture for combustion in the presence of said catalyst;

said downhole steam generator further including means for directly heating said emulsion and air which includes a device supported within said housing for conducting a portion of the heat of combustion of said fuel and air to said emulsion and air with said device including a heat conducting passage connected between said discharge chamber and said inlet chamber for a portion of the products of combustion to flow from said discharge chamber into said inlet chamber for direct preheating of said emulsion and air.

74. A downhole steam generator comprising means for catalytically combusting an emulsion comprised of water and carbonaceous fuel mixed in a thermally self-extinguishing mass ratio so catalytic combustion of the fuel directly heats the water to produce steam, means for providing substantially stoichiometric quantities of the fuel and air for such combustion, said means for catalytically combusting including a housing with an inlet chamber toward one end thereof and a discharge chamber toward the other end thereof, and a catalyst supported within said housing between said chambers, said emulsion and air being received within said inlet chamber to form an inlet mixture for combustion in the presence of said catalyst;

said means for providing stoichiometric quantities of said fuel and air including an emulsion flow control, an air flow control, sensor means for said steam, and computer means connected between said sensor means and said flow controls for receiving from said sensor means a signal representative of a sensed characteristic of said steam and sending at least one control signal to at least one of said flow controls in response thereto to vary the relative mass flow between said emulsion and said air to obtain substantially stoichiometric quantity thereof; and said downhole steam generator further including means for directly heating said emulsion and air which includes a device supported within said housing for conducting a portion of the heat of combustion of said fuel and air to said emulsion and air with said device including a heat conducting passage connected between said discharge chamber and said inlet chamber for a portion of the products of combustion to flow from said discharge chamber into said inlet chamber for preheating said emulsion and air.

75. A process for producing a heated working fluid by combusting a carbonaceous fuel in a combustor comprising the steps of:

(a) mixing the carbonaceous fuel with a noncombustible diluent to form a fuel-mixture which has a mass ratio of diluent to fuel that is thermally self-extinguishing, (b) providing a substantially stoichiometric quantity of oxidant to the fuel-mixture for substantially stoichiometric combustion, (c) catalytically combusting said fuel-mixture and oxidant to directly heat the diluent in the mixture to produce a heated working fluid comprised of the heated diluent and the products of such combustion, and (d) controlling the mass ratio of said burn-mixture relative to the mass of said oxidant by flowing said masses over said catalyst and, (1) sensing a characteristic of said working fluid representative of stoichiometric combustion of said fuel-mixture, and (2) varying the flow rate of said fuel-mixture relative to the flow rate of said oxidant in accordance with said sensed characteristic to change the ratio of relative mass flow to obtain stoichiometric quantities of oxidant and fuel prior to combustion, (3) comparing first and second time spaced temperatures of said heated working fluid, (4) comparing a first ratio of relative mass flows of a mixture to oxidant which results in production of said working fluid at said first temperature, against a second ratio of relative mass flows of said working fluid at said second temperature, and increasing the relative mass flow of said mixture to said oxidant if, said second ratio is greater than said first ratio and said second temperature is greater than said first temperature, or if, said second ratio is less than said first ratio and said second temperature is less than said first temperature, or, decreasing the relative mass flow of said mixture to said oxidant if, said second ratio is less than said first ratio and said second temperature is greater than said first temperature, or if, said second ratio is greater than said first ratio and said second temperature is less than said first temperature.

76. A downhole steam generator as defined by claims 68, 70, 73 or 74 including a mass ratio control for setting the mass ratio of said water relative to said fuel, said sensor means including a temperature sensor for detecting the actual temperature of said steam, said computer means further providing for comparing said actual temperature to a predesignated maximum temperature and sending another control signal to said mass ratio control as determined by said last mentioned comparison to increase said mass ratio for keeping said actual temperature less than said predesignated maximum temperature.

77. A downhole steam generator as defined by claim 76 wherein said computer means further provides for comparing said actual temperature to a predesignated minimum temperature and sending still another control signal to said mass ratio control as determined by this latter comparison to decrease said mass ratio for keeping said actual temperature no less than said predesignated minimum temperature.

78. A downhole steam generator as defined by claim 74 including a post-combustion injector for spraying water into said steam for cooling purposes, an injection water control, said temperature sensor detecting the temperature of said steam prior to injection of said water, said computer means further being connected between said sensor and said injection water control for transmitting a water control signal to said water control to cause said latter control to adjust the flow of said water into said steam for lowering the temperature thereof to a selected temperature.

79. A downhole steam generator as defined by claims 68, 70, 73 or 74 including a post-combustion injector for spraying water into said steam for cooling purposes, an injection water control, said sensor means detecting the temperature of said steam prior to injecting said water, said computer means further being connected between said sensor means and said injection water control for transmitting a water control signal to said water control to causes said latter control to adjust the flow of said water into said steam for lowering the temperature thereof to a selected temperature.

80. A downhole steam generator as defined by claim 79 including a post-injection temperature sensor for detecting the temperature of said steam after injection of said water, said computer means being connected with said latter sensor for comparing said post-injection temperature to said selected temperature and transmitting an appropriate signal to said injection watercontrol to adjust the flow of said water to cool said steam to said selected temperature.

* * * * *